US009757956B2

(12) United States Patent
Ishimi et al.

(10) Patent No.: US 9,757,956 B2
(45) Date of Patent: Sep. 12, 2017

(54) IMAGE PROCESSING METHOD AND IMAGE PROCESSING APPARATUS

(71) Applicants: Tomomi Ishimi, Shizuoka (JP); Shinya Kawahara, Shizuoka (JP); Toshiaki Asai, Shizuoka (JP); Katsuya Ohi, Shizuoka (JP)

(72) Inventors: Tomomi Ishimi, Shizuoka (JP); Shinya Kawahara, Shizuoka (JP); Toshiaki Asai, Shizuoka (JP); Katsuya Ohi, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/777,053

(22) PCT Filed: Mar. 13, 2014

(86) PCT No.: PCT/JP2014/057644

§ 371 (c)(1),
(2) Date: Sep. 15, 2015

(87) PCT Pub. No.: WO2014/156912

PCT Pub. Date: Oct. 2, 2014

(65) Prior Publication Data

US 2016/0279968 A1 Sep. 29, 2016

(30) Foreign Application Priority Data

Mar. 25, 2013 (JP) ..... 2013-061771
Mar. 29, 2013 (JP) ..... 2013-073108

(51) Int. Cl.
*B41J 2/475* (2006.01)
*B41M 7/00* (2006.01)
(Continued)

(52) U.S. Cl.
CPC ..... *B41J 2/4753* (2013.01); *B41J 2/32* (2013.01); *B41J 2/442* (2013.01); *B41M 7/0009* (2013.01);
(Continued)

(58) Field of Classification Search
CPC ..... B41M 7/00; B41M 7/0009; B41M 7/009; B41J 2/4753; B41J 2/442; B41J 2/32; B41J 2002/4756; B41J 2202/37
See application file for complete search history.

(56) References Cited

U.S. PATENT DOCUMENTS

2007/0225162 A1 9/2007 Kawahara et al.
2008/0064596 A1 3/2008 Iino et al.
(Continued)

FOREIGN PATENT DOCUMENTS

EP 2492103 8/2012
JP 62-201478 9/1987
(Continued)

OTHER PUBLICATIONS

Japanese official action dated Sep. 13, 2016 in corresponding Japanese Patent Application No. 201401482.
(Continued)

*Primary Examiner* — Kristal Feggins
(74) *Attorney, Agent, or Firm* — Cooper & Dunham LLP

(57) ABSTRACT

Provided is an image processing apparatus configured to perform by itself image erasing and image recording to a thermally reversible recording medium by irradiating it with laser light and heating it, including a laser light emitting unit, a laser light scanning unit, a focal length control unit, and an information setting unit. During image erasing, the focal length control unit performs control to defocus at the position of the thermally reversible recording medium. During image recording, the focal length control unit performs
(Continued)

control to be at a focal length from the position of the thermally reversible recording medium. Immediately after image erasing based on image erasing information set by the information setting unit is completed, image recording is performed based on image recording information.

20 Claims, 12 Drawing Sheets

(51) Int. Cl.
*B41J 2/32* (2006.01)
*B41J 2/44* (2006.01)

(52) U.S. Cl.
CPC .... *B41J 2002/4756* (2013.01); *B41J 2202/37* (2013.01)

(56) References Cited

U.S. PATENT DOCUMENTS

| | | | |
|---|---|---|---|
| 2008/0192618 | A1 | 8/2008 | Nakata et al. |
| 2012/0211673 | A1 | 8/2012 | Yamamoto |
| 2012/0218540 | A1 | 8/2012 | Ishimi et al. |
| 2013/0141512 | A1 | 6/2013 | Asai et al. |

FOREIGN PATENT DOCUMENTS

| | | |
|---|---|---|
| JP | 07-179061 | 7/1995 |
| JP | 09-030118 | 2/1997 |
| JP | 11-151856 | 6/1999 |
| JP | 2000-136022 | 5/2000 |
| JP | 2004-265249 | 9/2004 |
| JP | 2004-295247 | 9/2004 |
| JP | 2004-341317 | 12/2004 |
| JP | 2006-035883 | 2/2006 |
| JP | 2007-076122 | 3/2007 |
| JP | 2008-006468 | 1/2008 |
| JP | 2008-062506 | 3/2008 |
| JP | 2008-068312 | 3/2008 |
| JP | 2008-194905 | 8/2008 |
| JP | 2008-213439 | 9/2008 |
| JP | 2009-023209 | 2/2009 |
| JP | 2009-208093 | 9/2009 |
| JP | 2009-285693 | 12/2009 |
| JP | 2010-061110 | 3/2010 |
| JP | 2010-192015 | 9/2010 |
| JP | 2012-192731 | 10/2012 |
| WO | WO2012/033146 | 3/2012 |

OTHER PUBLICATIONS

Japanese official action dated Sep. 13, 2016 in corresponding Japanese Patent Application No. 2014-045875.

Korean official action dated Apr. 17, 2017 in connection with corresponding Korean patent application No. 10-2015-7030675.

Diginfonews. "Ricoh Contactless Thermal Rewritable Laser System—Labels Reusable 1000 times #DigInfo." YouTube Video, Sep. 17, 2012. (https://www.youtube.com/watch?v=QVESpulukeo).

International Search Report Issued Apr. 22, 2014 for counterpart International Patent Application No. PCT/JP2014/057644 dated Mar. 13, 2014.

IMAGE PROCESSING METHOD AND IMAGE PROCESSING APPARATUS

TECHNICAL FIELD

The present invention relates to an image processing method and an image processing apparatus that need one apparatus to enable high speed image rewriting.

BACKGROUND ART

Conventionally, images have been recorded onto or erased from a thermally reversible recording medium according to a contact recording method of bringing a heating source into contact with the thermally reversible recording medium and heating the thermally reversible recording medium. As the heating source, a thermal head or the like is typically used for image recording, and a heating roller, a ceramic heater, or the like is typically used for image erasing. Advantageously, such a contact recording method enables uniform recording or erasing of images onto or from a thermally reversible recording medium by pressing the thermally reversible recording medium onto the heating source uniformly with a platen or the like when the thermally reversible recording medium is a flexible medium such as film and paper, and enables manufacture of an image recording apparatus and an image erasing apparatus at low costs by allowing diversion of components of printers for conventional heat-sensitive sheets.

There is a request for image rewriting to be performed to a thermally reversible recording medium from a remote position. For example, there is proposed a method of using a laser, as a method for recording and erasing images onto or from a thermally reversible recording medium uniformly, when there are undulations on the surface of the thermally reversible recording medium or from a remote place (see PTL 1). The proposed method is described to perform contactless recording to a thermally reversible recording medium pasted on a shipping container used on a distribution line, and to perform writing by a laser and erasing by hot air, hot water, or an infrared heater.

As such a recording method by a laser, there is provided a laser recording apparatus (laser marker) that irradiates a thermally reversible recording medium with high-power laser light and can control the position of the light. With this laser marker, a thermally reversible recording medium is irradiated with laser light, a photothermic material in the thermally reversible recording medium absorbs the light and converts it to heat, and recording and erasing are performed with this heat. As a method for recording and erasing images by a laser, there has been proposed a method of combining a leuco dye, a reversible developer, and various photothermic materials, and recording images by near infrared laser light (see PTL 2).

Further, use of the conventional techniques described in PTL 3 and PTL 4 enables uniform heating of a recording medium, and enables improvement of image quality and repetition durability. However, there is a problem that a time required for image recording and image erasing is long due to jumps between respective lines to be drawn, and wait times.

There is also proposed a method of detecting a surface state of a thermally reversible recording medium and controlling the irradiation energy during image recording according to the detection (see PTL 5). This proposed method enables recording of a high-quality image by controlling the irradiation energy even with respect to minute undulations, but necessitates highly precise control to bring about a problem that the cost of the apparatus will be expensive.

There is also proposed a method of adjusting an irradiation spot diameter to be constant by detecting the position of a thermally reversible recording medium and controlling the position of the lens according to the position detection result (see PTL 6). However, this proposal has a problem that the lens system for controlling the irradiation spot diameter will be complicated to raise the cost of the apparatus.

Recently, low-costing and space-saving image processing apparatuses have also been requested, and there has been proposed an image processing method of performing both of image erasing and image recording with one image processing apparatus (one laser emitting unit). In this case, the throughput is usually determined by the sum of a time taken for image erasing, a time taken for image recording, and a time taken from the end of image erasing until the start of image recording. As one method for realizing a high throughput, there is a method of reducing a time taken from the end of image erasing until the start of image recording. However, it takes time to shift from image erasing to image recording, and it has been unable to perform image rewriting at high speed. A time during which a shipping container on which a thermally reversible recording medium is pasted is conveyed, and a wait time during which the shipping container having been conveyed ceases to vibrate are not necessary, and it is only necessary to secure a time during which image erasing and image recording are switched within the image processing apparatus. Therefore, it is possible to greatly reduce the time from the end of image erasing until the start of image recording.

There is proposed an overwrite rewriting method of performing rewriting with one image processing apparatus (one laser emitting unit) (see PTL 7). This proposal describes a rewriting method of changing the beam diameter per dot between printing and erasing. However, with this proposal, it is difficult to switch the beam diameter at high speed per dot, and partial erasing may leave unerased portions if it is by rewriting per dot. Therefore, there are problems regarding image rewriting at high speed, and securement of image erasing performance.

Further, as a method for performing rewriting with one image processing apparatus (one laser emitting unit), there is proposed a method of moving the image processing apparatus or a thermally reversible recording medium to change the relative distance between the image processing apparatus and the thermally reversible recording medium (see PTL 8). However, with this proposal, it takes time to move the image processing apparatus or the thermally reversible recording medium, and it is difficult to perform rewriting at high speed.

There is also proposed a laser marking apparatus mounted with a focal length adjusting unit (see PTL 9 and PTL 10). With the focal length adjusting unit, it is possible to shift from image erasing to image recording within a short time of 1 second or shorter. At this time, heat applied to the thermally reversible recording medium for erasing the image accumulates, and this heat dissipates at short time scales. When laser light irradiation is employed as a method for applying heat, the time at which heat is applied varies from region to region within the thermally reversible recording medium, and the temperature of the thermally reversible recording medium therefore becomes non-uniform. If an image is recorded onto the thermally reversible recording medium on which the temperature is non-uniform, quenching of the thermally reversible recording layer is inhibited to thereby cause problems such as degradation of the density of an image to be drawn and degradation of repetition durability, and a region having a high temperature will be under excessive heat during image recording when an image is recorded onto the thermally reversible recording medium on which the temperature is non-uniform with a fixed laser output, to thereby thicken the line width, collapse characters and symbols, degrade the image density, and reduce readability of an information code and repetition durability.

There haven not yet been any reports on problems due to employment of an image processing apparatus mounted with the focal length adjusting unit to high speed rewriting of a thermally reversible recording medium. Such problems are more remarkable when recording plural-line drawn images to be formed by a plurality of adjacent laser light drawn lines than when recording single-line drawn images to be formed by a single adjacent-line-less drawn line. Urgent resolution of such problems is requested.

Currently available image rewriting systems in which an image erasing apparatus and an image recording apparatus are arranged side by side can perform an image erasing step and an image recording step in parallel with the image erasing apparatus and the image recording apparatus arranged side by side and are advantageous for high speed rewriting, whereas an image forming apparatus of the present invention performs an erasing step and a recording step by turns by itself, and is problematic for high speed rewriting because it necessitates a time to switch from the erasing step to the recording step. In order to realize similar processing performance to that of the currently available image rewriting systems, the image forming apparatus of the present invention needs three techniques, namely, speeding up of the erasing step, speeding up of the recording step, and reduction of the time taken to switch from the erasing step to the recording step.

Recent development of higher-power laser light sources has enabled raising of the irradiation power of laser light. By raising the irradiation power of the laser light, it has become possible to raise the temperature of the recording layer of the thermally reversible recording medium within a short time by applying energy, and to thereby realize a high speed erasing step and a high speed recording step.

However, in terms of speeding up the erasing step, not only a time during which to reach the aimed temperature but also a heating time for which the aimed temperature is maintained are necessary for erasing, and it is impossible to realize high speed erasing only by raising the irradiation power. When a spot diameter is d and a scanning velocity is V, heating time is expressed as d/V. Therefore, as a method for speeding up the erasing step, it is possible to increase a heating time for which a position is kept heated, by increasing the spot diameter of the laser light during the erasing step. Therefore, it is necessary to realize high speed erasing, by increasing the spot diameter d to thereby maintain the heating time constant even when the scanning velocity V is increased as is necessitated for speeding up.

As for image recording, in order to realize precise image formation during image recording and to secure room of margin for fluctuation of a work distance, it is preferable to control a focal length to be achieved at the position of the thermally reversible recording medium, with the focal length adjusting unit. However, there are problems regarding high speed recording, and degradation of repetition durability due to damages to the thermally reversible recording medium depending on the position thereof at which it is to be irradiated with laser light having high energy density because the beam diameter becomes small when the focal length is at the position. Meanwhile, reduction of the time taken to switch from the erasing step to the recording step is also a necessary technique.

Hence, in order to realize a space-saving image processing apparatus, it is necessary to perform high speed rewriting with one image processing apparatus (one laser emitting unit), and to perform image recording immediately after image erasing. However, a sufficiently satisfactory apparatus has not been provided yet.

CITATION LIST

Patent Literature

PTL 1 Japanese Patent Application Laid-Open (JP-A) No. 2000-136022
PTL 2 JP-A No. 11-151856
PTL 3 JP-A No. 2008-62506
PTL 4 JP-A No. 2008-213439
PTL 5 JP-A No. 2008-194905
PTL 6 JP-A No. 2008-68312
PTL 7 JP-A No. 2006-35683
PTL 8 JP-A No. 2007-76122
PTL 9 JP-A No. 2008-6468
PTL 10 JP-A No. 2009-208093

SUMMARY OF INVENTION

Technical Problem

An object of the present invention is to provide an image processing method that can realize high speed image rewriting and space saving with one image processing apparatus.

Another object of the present invention is to provide an image processing apparatus for reduction of a time taken to switch from image erasing to image recording, which is a challenge to be achieved for realizing high speed image rewriting (image recording after image erasing) with one image processing apparatus, and an image processing method that can realize high-quality images and improve repetition durability and barcode readability.

Solution to Problem

Solutions to the problems are as follows.

In a first embodiment, an image processing apparatus of the present invention, which is an image processing apparatus configured to perform by itself image erasing and image recording to a thermally reversible recording medium by irradiating the thermally reversible recording medium with laser light and heating it, includes:

a laser light emitting unit configured to emit the laser light;

a laser light scanning unit configured to scan the laser light over a laser light irradiation surface of the thermally reversible recording medium;

a focal length control unit including a position-shiftable lens system between the laser light emitting unit and the laser light scanning unit and configured to control the focal length of the laser light by adjusting the position of the lens system; and an information setting unit configured to receive and set image erasing information, image recording information, and distance information representing the distance between the thermally reversible recording medium and a laser light emitting surface of the laser light emitting unit, which are input thereto, wherein during image erasing, the focal length control unit performs control to defocus at the position of the thermally reversible recording medium, wherein during image recording, the focal length control unit controls the position of the thermally reversible recording medium to be at a focal length, and wherein immediately after image erasing based on the image erasing information set by the information setting unit is completed, image recording is performed based on the image recording information.

In a second embodiment, an image processing apparatus of the present invention is the image processing apparatus of the first embodiment, wherein the laser light emitting unit controls the power of the laser light based on pulse length and peak power, and varies the peak power during image erasing from the peak power during image recording.

In a first embodiment, an image processing method of the present invention is an image processing method using the image processing apparatus of the first embodiment of the present invention, and includes:

an image recording step of at least any of irradiating a thermally reversible recording medium with laser light and heating the thermally reversible recording medium to thereby record thereon, a single-line drawn image to be formed by a single laser light drawn line, and irradiating the thermally reversible recording medium with laser light beams having certain intervals therebetween in parallel and heating the thermally reversible recording medium to thereby record thereon, a plural-line drawn image to be formed by a plurality of laser light drawn lines; and an image erasing step of irradiating the thermally reversible recording medium with laser light and heating the thermally reversible recording medium to thereby erase at least any of the single-line drawn image and the plural-line drawn image, wherein in the image recording step after the image erasing step is performed, the single-line drawn image is at least partially recorded before the plural-line drawn image is recorded.

In a second embodiment, an image processing method of the present invention is an image processing method using the image processing apparatus of the first embodiment of the present invention, and includes:

an image recording step of at least any of irradiating a thermally reversible recording medium with laser light and heating the thermally reversible recording medium to thereby record thereon, a single-line drawn image to be formed by a single laser light drawn line, and irradiating the thermally reversible recording medium with laser light beams having certain intervals therebetween in parallel and heating the thermally reversible recording medium to thereby record thereon, a plural-line drawn image to be formed by a plurality of laser light drawn lines; and an image erasing step of irradiating the thermally reversible recording medium with laser light and heating the thermally reversible recording medium to thereby erase at least any of the single-line drawn image and the plural-line drawn image, wherein in the image recording step after the image erasing step is performed, the single-line drawn image is at least partially recorded before the plural-line drawn image is recorded.

A conveyor system of the present invention incorporates therein at least any of the image processing apparatus of any of the first embodiment and the second embodiment of the present invention and the image processing method of any of the first embodiment and the second embodiment of the present invention, so that image processing may be performed based on information from the conveyor system.

Advantageous Effects of Invention

The present invention can provide an image processing apparatus that can solve the conventional problems described above, and can realize high speed image rewriting and space saving with one image processing apparatus.

The present invention can also provide an image processing apparatus for reduction of a time taken to switch from image erasing to image recording, which is a challenge to be achieved for realizing high speed image rewriting (image recording after image erasing) with one image processing apparatus, and an image processing method that can realize high-quality images and improve repetition durability and barcode readability.

Figure 1:
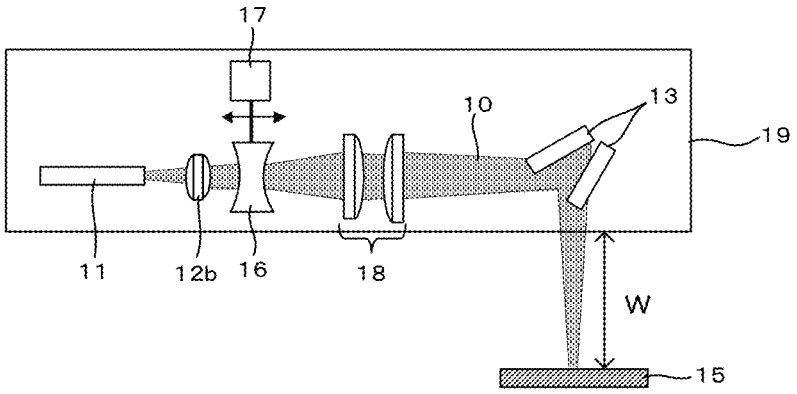
FIG. 1 is a schematic diagram showing an example image processing apparatus of the present invention, where W represents work distance.

DESCRIPTION OF EMBODIMENTS (Image Processing Method and Image Processing Apparatus)

An image processing apparatus of the present invention is an image processing apparatus configured to irradiate a thermally reversible recording medium with laser light and heating the thermally reversible recording medium to thereby erase an image from and record and image onto the thermally reversible recording medium by itself.

The image processing apparatus includes a laser light emitting unit, a laser light scanning unit, a focal length control unit, and an information setting unit.

An image processing method of the present invention is an image processing method using the image processing apparatus of the present invention and includes an image recording step and an image erasing step, and further includes other steps according to necessity.

Clients of rewriting systems for rewriting a thermally reversible recording medium by pasting it on a shipping container used on a distribution line demand achievement of cost saving and space saving of the image processing apparatus, and achievement of high speed image processing. Because conventional systems perform rewriting by using two apparatuses, namely an image erasing apparatus and an image recording apparatus, it has been difficult to achieve the demands of the clients. It is an effective way to perform image rewriting with one image processing apparatus for achieving cost saving and space saving of such systems as an image recording apparatus and a conveyor. However, in this way, it takes time to shift from an image erasing step to an image recording step, and it has been difficult to perform rewriting at high speed.

When recording an image onto and erasing an image from a thermally reversible recording medium with the rewriting system for rewriting a thermally reversible recording medium by pasting it on a shipping container used on a distribution line, suitable beam diameters on the thermally reversible recording medium are different for high speed and high quality image recording and for image erasing. Therefore, it is necessary to change the beam diameter between the image recording step and the image erasing step.

When a spot diameter is d and a scanning velocity is V, heating time is expressed as d/V. Therefore, as a method for speeding up the erasing step, it is possible to increase a time for which a position is kept heated, by increasing the spot diameter of the laser light during the erasing step. It is necessary to realize high speed erasing, by increasing the spot diameter d to thereby maintain the heating time constant even when the scanning velocity V is increased as is necessitated for speeding up. Spot diameter can be increased by making the focal length control unit defocus at the position of the thermally reversible recording medium, during the image erasing.

Examples of means for changing the beam diameter include a means for changing the distance between the thermally reversible recording medium and the laser light emitting surface of the laser light emitting unit, and a means for changing the focal length by shifting the position of the lens in the image recording system.

The means for changing the distance between the thermally reversible recording medium and the laser light emitting surface of the laser light emitting unit changes the beam diameter by shifting the position of the laser light emitting unit of the image recording apparatus or of the shipping container on which the thermally reversible recording medium is pasted. However, this means is unsuitable for a high speed process, because it takes 1 second or more as a stopping time taken for movement and vibration to become extinct (for proper image recording).

On the other hand, the means for changing the focal length by shifting the position of the lens in the image recording apparatus can realize a high speed process, because the focal length control unit in the image recording apparatus takes 20 ms or less to shift the lens from a position at which a beam diameter suitable for image recording is achieved to a position at which a beam diameter suitable for image erasing is achieved. However, the focal length greatly changes due to the lens shift from the position at which the beam diameter suitable for image recording is achieved to the position at which the beam diameter suitable for image erasing is achieved. Therefore, for example, in the image processing apparatus of the present invention shown in FIG. 1, in order for the diameter of laser light 10 to fall within the size of a galvano mirror 13, it is necessary to achieve a focal length in front of the position of the thermally reversible recording medium during the image erasing. In contrast, when the focal length is adjusted to be achieved at a position behind the thermally reversible recording medium during the image erasing, it is necessary to increase the size of the galvano mirror 13, which increases the costs because upsizing of the galvano mirror is necessary.

In order to perform high speed image rewriting with one image forming apparatus, it is necessary to perform image recording based on the image recording information immediately after image erasing based on image erasing information is completed.

When image erasing and image recording by the image processing apparatus are performed with different process files, it takes 200 ms to transfer information from the image setting unit to a control unit that controls a galvano unit and a laser unit, and it takes 200 ms to shift from the image recording step to the image erasing step. Therefore, the effect of speeding up of changing of the beam diameter by the focal length control unit (to 20 ms or less) cannot be sufficiently taken advantage of.

The rewriting system of rewriting a thermally reversible recording medium by pasting it on a shipping container used on a distribution line needs to process 1,500 shipping containers per hour, and needs to perform a rewriting process in 2.4 seconds per one shipping container. Actually, there are a time taken for a shipping container to arrive in front of the image processing apparatus and a stopping time, the total of both of which is 0.6 seconds. Therefore, the time left actually available is 1.8 seconds.

On this basis, it takes 1.1 seconds to erase an image from a label having a label size of (50 mm×80 mm) that is used on site, and it takes 0.6 seconds to record an image. Therefore, the time taken to shift from the image erasing to the image recording needs to 0.1 seconds or less (100 ms or less).

The image processing apparatus of the present invention includes a light focusing optical system. Therefore, laser light emitted by the apparatus is focused at the focal length position to have the minimum spot diameter. Such an optical system has a characteristic of having the same spot diameter in the vicinity of the focal length position (beam waist characteristic), which is preferable because fluctuation of the position of the thermally reversible recording medium becomes less influential. A defocus position is a position out of the vicinity of the focal position to have a large spot diameter. In the image erasing step, image erasing is performed by making the scanned positions overlap by setting the spot diameter large, in order to heat the thermally reversible recording medium uniformly. In this way, it is possible to realize uniform erasing. In order to ensure erasing performance, it is preferable to perform erasing at a defocus position.

According to the present invention, high speed image rewriting can be realized, because it is possible to realize changes to the beam diameters suitable for image erasing and image recording at high speed by changing the focal length with the focal length control unit of the image processing apparatus without shifting the positions of the thermally reversible recording medium and image processing apparatus, it is possible to realize image recording and image erasing with one image processing apparatus, and it is possible to do with one beam diameter change from the erasing step to the recording step by performing image printing after the image erasing is completed. When image erasing and image recording are performed at high speed with highly precise image quality, the beam diameter is greatly different between image erasing and image recording, and it takes time to change the beam diameter. Therefore, it is necessary to minimize the number of times to perform beam diameter switching, in order to realize high speed rewriting. The above-described system of the present invention is neither disclosed nor suggested in the conventional art.

<Image Processing Apparatus of First Embodiment>

An image processing apparatus of the first embodiment is an image processing apparatus configured to irradiate a thermally reversible recording medium with laser light and heating the thermally reversible recording medium to thereby erase an image from and record an image onto the thermally reversible recording medium by itself, and includes:

a laser light emitting unit configured to emit the laser light;

a laser light scanning unit configured to scan the laser light over a laser light irradiation surface of the thermally reversible recording medium;

a focal length control unit including a position-shiftable lens system between the laser light emitting unit and the laser light scanning unit, and configured to control the focal length of the laser light by adjusting the position of the lens system; and an information setting unit configured to receive and set image erasing information, image recording information, and distance information representing the distance between the thermally reversible recording medium and the laser light emitting surface of the laser light emitting unit, which are input thereto, wherein during image erasing, the focal length control unit performs control to defocus at the position of the thermally reversible recording medium, wherein during image recording, the focal length control unit performs control to be at a focal length from the position of the thermally reversible recording medium, and wherein immediately after image erasing based on the image erasing information set by the information setting unit is completed, image recording is performed based on the image recording information.

Here, "immediately after" in the "immediately after image erasing is completed" means 1.0 second or less, preferably 0.6 seconds or less, and more preferably 0.2 seconds or less.

The image processing apparatus of the first embodiment can reduce the time taken for a condition setting file to be transferred to the apparatus by operating with one control file for image erasing information, image recording information, and distance information, and can realize high speed image rewriting.

Further, since the distance information is set with the one control file, the image erasing step and the image recording step inevitably have the same distance information, and any troubles due to input errors can be prevented.

Furthermore, because the image recording step and the image erasing step are switched at high speed, image recording is performed in the heat accumulated state immediately after the image erasing. Therefore, during the image recording, colors can be developed even with low irradiation power, which would reduce damages to the thermally reversible recording medium to thereby improve the repetition durability thereof. With the suppression of the irradiation power, load on the laser light source can be reduced, and the life of the image processing apparatus can be improved.

<Image Processing Apparatus of Second Embodiment>

An image processing apparatus of the second embodiment is the image processing apparatus of the first embodiment, wherein the laser light emitting unit controls the power of the laser light based on pulse length and peak power, and varies the peak power from image erasing to image recording.

In the image processing apparatus of the second embodiment, the laser light emitting unit configured to emit laser light controls the power of the laser light based on pulse length and peak power, and varies the peak power between the image erasing and the image recording to thereby reduce damages to the thermally reversible recording medium during the image recording and improve the repetition durability. Specific explanation will be given below.

In order to reduce times taken for the image recording step and the image erasing step, it is necessary to heat the recording layer of the thermally reversible recording medium within a short time, which can be realized by increasing the irradiation power of the laser light source.

In the image erasing, the heating temperature for heating the recording layer is lower than in the image recording, but the heating time needs to be longer than in the image recording. During the image erasing, by increasing the beam diameter and applying laser irradiation with high power in order to realize the erasing at high speed, it is possible to reduce the heating time necessary for erasing and to realize the heating temperature necessary for erasing within a short time. On the other hand, during the image recording, it is necessary to reduce the beam diameter in order to realize image recording with high precision and at high speed, which requires adjustment in the vicinity of the focal length.

Figure 10:
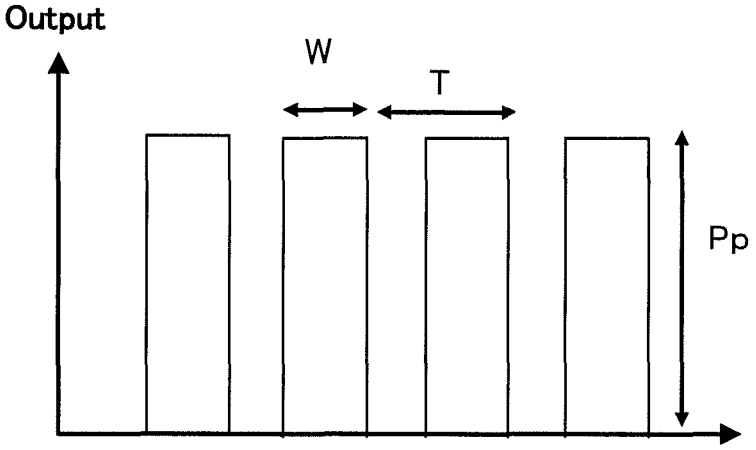
FIG. 10 is a schematic diagram showing an example method for controlling irradiation power of laser light, where D=W/T where T represents pulse cycle, W represents pulse width, and D represents duty, and where average power Pw can be expressed using peak power Pp as Pw=Pp×D.

Examples of the method for controlling the irradiation power of the laser light include a peak power control method and a pulse control method as shown in FIG. 10. When peak power is Pp and duty of the pulse is D (D=W/T, where T is cycle and W is pulse width), average irradiation power Pw is expressed as Pw=Pp×D. Image recording and image erasing to the thermally reversible recording medium is dependent not on Pp and D, but on Pw.

The peak power control method cannot change the peak power Pp at high speed and is unsuitable because the irradiation power needs to be changed at high speed for the image recording. The pulse control method can realize high speed control. However, when a high peak power is set to match the setting in the image erasing, the thermally reversible recording medium is irradiated during the image recording with laser light having a narrow pulse width but a high peak power for a short time, leading to degradation of repetition durability, which was discovered for the first time by the studies made by the present inventors.

When performing rewriting with one image forming apparatus, use of either one of the peak power control method and the pulse control method cannot realize both of high speed response and repetition durability at the same time. Hence, in the present invention, the laser light emitting unit configured to emit laser light employs both of peak power control and pulse control as the irradiation power control method. The laser light emitting unit uses peak power control only for peak power change between two levels for switching between image erasing and image recording while keeping the peak power constant during image recording and image erasing during which high power control is unnecessary, and uses pulse control for power control within each of the image recording step and the image erasing step because high speed power control is necessary within each of these steps. With the method of the present invention, it is possible to realize image recording at high speed and to improve the repetition durability by reducing damages to the thermally reversible recording medium.

<<Laser Light Emitting Unit>>

The laser light emitting unit is a unit configured to emit laser light. Examples thereof include a YAG laser, a fiber laser, a laser diode (LD), and a fiber-coupled laser. Among these, a fiber-coupled laser is particularly preferable because one can easily produce a top-hat-shaped light distribution and thus can record a highly visible image.

The wavelength of the laser light emitted by the laser light emitting unit is not particularly limited and may be appropriately selected according to the purpose. However, it is preferably 700 nm or greater, more preferably 720 nm or greater, and yet more preferably 750 nm or greater. The upper limit of the wavelength of the laser light is preferably 1,600 nm or less, more preferably 1,300 nm or less, and yet more preferably 1,200 nm or less.

When the wavelength of the laser light is less than 700 nm, if it is within the visible spectrum, there are problems that the contrast during the image recording to the thermally reversible recording medium may degrade, or that the thermally reversible recording medium may be colored. In the ultraviolet spectrum in which the wavelength is even shorter, there is a problem that the thermally reversible recording medium becomes more susceptible to deterioration. The photothermic material added to the thermally reversible recording medium must have a high decomposition temperature in order for durability against repetitive image processing to be ensured. When using an organic pigment as the photothermic material, it is difficult to procure a photothermic material that has a high decomposition temperature and absorbs a long wavelength. Therefore, the wavelength of the laser light is preferably 1,600 nm or less.

The laser light scanning unit is a unit configured to scan the laser light emitted by the laser light emitting unit over a laser light irradiation surface of the thermally reversible recording medium.

The laser light scanning unit is not particularly limited and may be appropriately selected according to the purpose, as long as it is able to scan the laser light over the laser light irradiation surface. Examples thereof include a galvano meter, and a mirror mounted on the galvano meter.

<<Focal Length Control Unit>>

The focal length control unit is a unit that includes a position shiftable lens system between the laser light emitting unit and the laser light scanning unit, and is configured to control the focal length of the laser light by adjusting the position of the lens system.

During image erasing, the focal length control unit performs control to defocus at the position of the thermally reversible recording medium.

During image recording, the focal length control unit performs control to achieve a focal length at the position of the thermally reversible recording medium.

FIG. 1 is a schematic diagram showing an example image processing apparatus of the present invention. In the optical system of the image processing apparatus shown in FIG. 1, laser light emitted by a laser light source 11 is collimated by a collimator lens 12*b* to parallel light, and the light enters a diffusing lens 16 provided as the focal length control unit and is focused by a condensing lens 18 to be focused at a position that varies according to the position, in the laser light irradiating direction, of the diffusing lens 16 provided as the focal length control unit. The diffusing lens 16 as the focal length control unit is mounted on a lens position control mechanism 17 and is shiftable in the laser light irradiating direction. The lens position control mechanism 17 can perform high speed shifting based on pulse motor control, and can perform high speed focal length control.

<<Information Setting Unit>>

The information setting unit is a unit configured to receive and set image erasing information, image recording information, and distance information representing the distance between the thermally reversible recording medium and the laser light emitting surface of the laser light emitting unit, which are input thereto.

The image recording step and the image erasing step employ a method of controlling the focal length based on the value set as the distance information for the distance between the thermally reversible recording medium and the emitting surface of the laser light emitting unit.

The information setting unit creates a control file including image erasing information, image recording information, and distance information, and transfers the information to a control unit configured to control a galvano meter, a laser irradiation unit, etc. for operation.

Because the information transfer is not performed between the image recording step and the image erasing step, no waste time is taken to shift from the image recording step to the image erasing step.

The information transfer from the information setting unit to the control unit does not pose any problem for the whole system, because it is performed during the time during which a shipping container arrives in front of the image recording apparatus and during a stopping time.

Three modes, namely "image recording+image erasing", "image recording only", and "image erasing only" can be selected for the information setting unit. The present invention can be realized by selecting "image recording+image erasing" mode.

The image erasing information, the image recording information, and the distance information are used (executed) as one control file. Therefore, it is possible to reduce the time taken to transfer the control file to the image processing apparatus and to realize a high speed image rewriting.

<<Distance Measuring Unit>>

The distance measuring unit is a unit configured to measure the distance between the thermally reversible recording medium and the laser light emitting surface of the laser light emitting unit.

Here, the distance between the thermally reversible recording medium and the laser light emitting surface of the laser light emitting unit is also referred to as "work distance". The "work distance" can be measured with, for example, a ruler (scale), a sensor, etc. For making corrections to the "work distance" measured with a sensor, the distance may be measured with a laser displacement meter manufactured by Panasonic Corporation, and corrections may be made to the measurement results with the image processing apparatus.

Unless the thermally reversible recording medium is inclined greatly, the process of the distance measurement can be simplified, and this will realize low costs. Therefore, it is preferable to measure one position of the thermally reversible recording medium. When performing recording to an inclined thermally reversible recording medium, it is necessary to measure a plurality of positions, and it is preferable to measure three positions.

The distance measurement is not particularly limited and may be appropriately selected according to the purpose, and can be performed with, for example, a distance sensor.

Examples of the distance sensor include contactless distance sensor and contact sensor. A contact sensor would damage the measurement target medium, and can hardly realize high speed measurement. Therefore, a contactless distance sensor is preferable. Among contactless sensors, a laser displacement sensor is particularly preferable because it can realize precise and high speed distance measurement and is inexpensive and small in size.

With a possibility of the thermally reversible recording medium being inclined taken into consideration, the position to be measured with the distance sensor is preferably the central position of the thermally reversible recording medium to which an image is to be recorded, and which is at a distance corresponding to the average distance of the thermally reversible recording medium. In the distance measurement of a plurality of positions, a possibility of three-dimensional inclination is assumed based on the measurement results of the distance from the measured positions, and the assumed inclination is calculated in order for focal length correction to be made based on the irradiating position.

<<Temperature Measuring Unit>>

The temperature measuring unit is a unit configured to measure at least either temperature of the temperature of the thermally reversible recording medium and ambient temperature of the thermally reversible recording medium. The irradiation energy is controlled based on the measurement result of the temperature measuring unit.

Image recording and image erasing to the thermally reversible recording medium are performed by means of heat. Therefore, the optimum irradiation energy varies according to the temperature. Specifically, it is preferable to control the irradiation of the laser light to low energy when the temperature is high and to high energy when the temperature is low.

The temperature measurement is not particularly limited and may be appropriately selected according to the purpose. For example, it may be performed with a temperature sensor.

Examples of the temperature sensor include an ambient temperature sensor configured to measure ambient temperature, and a medium temperature sensor configured to measure the temperature of a medium.

A preferable example of the ambient temperature sensor is a thermister because it can be used at low costs and can measure at high speed and with high precision.

A preferable example of the medium temperature sensor is a radiation thermometer because it can measure contactlessly.

<<Image Recording>>

The image recording is a step of irradiating the thermally reversible recording medium with laser light of which irradiation energy is adjusted based on the measured distance and heating the thermally reversible recording medium to thereby record an image thereon.

The irradiation energy of the laser light is proportional to Pw/V (where Pw represents average irradiation power of the laser light on the thermally reversible recording medium, and V represents the scanning velocity of the laser light on the thermally reversible recording medium).

Therefore, it is preferable to adjust the irradiation power of the laser light by adjusting at least either of the scanning velocity (V) and the average irradiation power (Pw) of the laser light so as to make Pw/V generally constant.

The method for controlling the laser irradiation energy may be reducing the scanning velocity of the laser light or increasing the irradiation power when increasing the laser irradiation energy, and may be increasing the scanning velocity of the laser light or reducing the irradiation power when reducing the laser irradiation energy.

The method for controlling the scanning velocity of the laser light is not particularly limited and may be appropriately selected according to the purpose. Examples thereof include a method of controlling the rotation speed of a motor that is in charge of actuating a scanning mirror.

The method for controlling the irradiation power of the laser light may be appropriately selected according to the purpose. Examples thereof include a method of changing the set value of the light irradiation power, and a control method based on adjustment of peak power, pulse width (time), and duty.

Examples of the method for changing the set value of the light irradiation power include a method of changing the set value of the power depending on the recording regions. Examples of the control method based on the pulse time width include a method of changing the time width for which to emit a light pulse depending on the recording regions to thereby enable adjustment of the irradiation energy based on the irradiation power.

The power output of the laser light to be emitted in the image recording step is not particularly limited and may be appropriately selected according to the purpose. However, it is preferable 1 W or greater, more preferably 3 W or greater, and yet more preferably 5 W or greater. When the power output of the laser light is less than 1 W, it takes time to perform image recording, and the power output will run out if an attempt is made to complete image recording in a short time. The upper limit of the power output of the laser light is not particularly limited and may be appropriately selected. However, it is preferable 200 W or less, more preferably 150 W or less, and yet more preferably 100 W or less. When the power output of the laser light is greater than 200 W, upsizing of the laser device may be necessitated.

The scanning velocity of the laser light to be emitted in the image recording step is not particularly limited and may be appropriately selected according to the purpose. However, it is preferably 300 mm/s or greater, more preferably 500 mm/s or greater, and yet more preferably 700 mm/s or greater. When the scanning velocity is less than 300 mm/s, it takes time to perform image recording. The upper limit of the scanning velocity of the laser light is not particularly limited and may be appropriately selected according to the purpose. However, it is preferably 15,000 mm/s or less, more preferably 10,000 mm/s or less, and yet more preferably 8,000 mm/s or less. When the scanning velocity is greater than 15,000 mm/s, it becomes difficult to control the scanning velocity and to form a uniform image.

The spot diameter of the laser light to be emitted in the image recording step is not particularly limited and may be appropriately selected according to the purpose. However, it is preferably 0.02 mm or greater, more preferably 0.1 mm or greater, and yet more preferably 0.15 mm or greater. The upper limit of the spot diameter of the laser light is not particularly limited and may be appropriately selected according to the purpose. However, it is preferably 2.0 mm or less, more preferably 1.5 mm or less, and yet more preferably 1.0 mm or less. When the spot diameter is small, the line width of the image will be thin, which may degrade the visibility. When the spot diameter is large, the line width of the image will be bold, and adjacent lines may be overlaid. Therefore, recording of a small-size image may be impossible.

Examples of the laser light source include YAG laser light, fiber laser light, laser diode light, and fiber-coupled laser.

In order to realize highly visible laser recording, it is necessary to uniformly heat a recording region of the thermally reversible recording medium irradiated with the laser. Typical laser light has a Gaussian distribution having a high intensity at the central portion. When an image is recorded with such laser light, the image will have a contrast to become darker in the peripheral region than in the central region, resulting in poor visibility and poor image quality. As a means for avoiding this, a light distribution modifying optical element (e.g., an aspheric lens and a DOE element) may be incorporated into the optical path. However, this has been problematic because the apparatus cost will be high, and the optical design will be complicated in order to avoid light distribution unevenness due to aberration. However, when the fiber-coupled laser is used, the laser light to be emitted from the fiber end will have a top-hat shape, and it is easy to obtain laser light having a top-hat shape even without an optical distribution modifying optical element. Therefore, use of a fiber-coupled laser is particularly preferable because it will be possible to realize highly visible image recording.

With other lasers having a Gaussian distribution, the greater the difference from the focal length, the greater beam diameter the beam will have while keeping the Gaussian distribution unchanged, to thereby make the line width bolder as the difference from the focal length increases, resulting in degradation of the visibility. On the other hand, when a fiber-coupled laser is used, the beam will have a top-hat-shaped light distribution at the focal point, and as the difference from the focal length increases, the beam will have a greater beam diameter, but the diameter of the high-intensity portion at the center of the light distribution will not increase. Therefore, use of a fiber-coupled laser is particularly preferable because the line width of the image will not be bolder even when the difference from the focal length increases.

Laser light typically has a Gaussian distribution at the focal point, and keeps the Gaussian distribution unchanged even when the laser light comes away from the focal point, and the only change is an increase of the beam diameter. Therefore, even when the energy density is kept the same, the printing line width will increase in proportion to the beam diameter.

In the fiber-coupled laser, laser light is coupled to the fiber and homogenized through the fiber, to thereby have a top-hat-shaped light distribution at the focal point. As the distance from the focal point increases, the beam diameter increases, and the light distribution approaches a Gaussian distribution. A printing line width appears when the energy becomes greater than a certain level. Therefore, even when the energy density is kept the same, the beam diameter increases as the distance from the focal point increases, but the line width will not be broadened if the image is printed with the central portion of the Gaussian distribution, to thereby realize almost the same line width as that obtained at the focal point.

<Image Processing Method of First Embodiment>

An image processing method of the first embodiment is an image processing method using the image processing apparatus of the first embodiment, and includes:

an image recording step of at least either irradiating a thermally reversible recording medium with laser light and heating the thermally reversible recording medium to thereby record thereon, a single-line drawn image to be formed by a single laser light drawn line, or irradiating the thermally reversible recording medium with laser light beams having certain intervals therebetween in parallel and heating the thermally reversible recording medium to thereby record thereon, a plural-line drawn image to be formed by a plurality of laser light drawn lines; and an image erasing step of irradiating the thermally reversible recording medium with laser light and heating the thermally reversible recording medium to thereby erase at least any of the single-line drawn image and the plural-line drawn image, wherein in the image recording step after the image erasing step is performed, the single-line drawn image is at least partially recorded before the plural-line drawn image is recorded.

<Image Processing Method of Second Embodiment>

An image processing method of the second embodiment is an image processing method using the image processing apparatus of the first embodiment, and includes:

an image recording step of at least either irradiating a thermally reversible recording medium with laser light and heating the thermally reversible recording medium to thereby record thereon, a single-line drawn image to be formed by a single laser light drawn line, or irradiating the thermally reversible recording medium with laser light beams having certain intervals therebetween in parallel and heating the thermally reversible recording medium to thereby record thereon, a plural-line drawn image to be formed by a plurality of laser light drawn lines; and an image erasing step of irradiating the thermally reversible recording medium with laser light and heating the thermally reversible recording medium to thereby erase at least any of the single-line drawn image and the plural-line drawn image, wherein in the image erasing step before the image recording step is performed, a region to which a plural-line drawn image is to be recorded in the image recording step is completely erased, and after this, a region to which a single-line drawn image is to be recorded in the image recording step is at least partially erased.

When a drawn image is recorded on the thermally reversible recording medium immediately after an image having been recorded thereon is erased by irradiating the thermally reversible recording medium with laser light and heating it, there may occur problems such as degradation of the density of the drawn image and degradation of repetition durability. Further, when an image is recorded with a fixed laser output in the image recording step, there may occur problems such as line width broadening, collapsing of characters and symbols, degradation of the image density, degradation of the readability of an information code, and degradation of the repetition durability.

When the action is only to record a drawn image on the thermally reversible recording medium, or when a drawn image is to be recorded when a sufficient time has elapsed and heat has dissipated after heat has been applied to the thermally reversible recording medium to erase the image, the heated portion of the thermally reversible recording layer of the thermally reversible recording medium irradiated with the laser light will diffuse heat to around the heated portion of the thermally reversible recording layer, which will thus quench the thermally reversible recording layer.

However, when a drawn image is to be recorded on the thermally reversible recording medium immediately after heat is applied thereto to erase the image, the heat applied for the image erasing may have accumulated in the thermally reversible recording medium. If a drawn image is recorded at this timing, the thermally reversible recording layer will be cooled more slowly than when the action is only to record a drawn image on the thermally reversible recording medium, because heat has remained in the portions around the heated portion of the thermally reversible recording layer. It is considered that degradation of the density of the drawn image and degradation of the readability of an information code will occur as a result. This degradation of the density of the drawn image is more likely to occur as the time taken for image rewriting is reduced more in order to improve the throughput when performing both of image erasing and image recording with one image processing apparatus. That is, the degradation is more likely to occur as the time from the end of image erasing until the start of image recording is reduced more.

When recording a drawn image with a fixed laser output in the image recording step, it is necessary to set the output of the laser so as to enable a sufficient image density to be obtained when an image is recorded in a region that has accumulated heat the least. However, when an image is recorded with this output value in a region which has accumulated heat much, the thermally reversible recording layer will be heated excessively. It is considered that degradation of the repetition durability, degradation of the readability of an information code, and collapsing of characters and symbols will occur as a result. These phenomena are more likely to occur as the time taken for image rewriting is reduced more in order to improve the throughput when performing both of image erasing and image recording with one image processing apparatus. That is, these phenomena are more likely to occur as the time from the end of image erasing until the start of image recording is reduced more.

Further, these problems are more likely to occur in a drawn image to be formed by a plurality of adjacent laser light drawn lines than in a drawn image to be formed by an adjacent-line-less single image line. This is because an adjacent-line-less single drawn line will heat a more narrow region of the thermally reversible recording layer of the thermally reversible recording medium than a drawn image formed by a plurality of adjacent laser light drawn lines, and hence heat dissipation from the heated region of the thermally reversible recording layer to the surrounding regions becomes faster to thereby quench the thermally reversible recording layer and make it less susceptible to excessive heat.

In the image processing method of the first embodiment, in the image recording step after the image erasing step is performed, a single-line drawn image is at least partially recorded before a plural-line drawn image is recorded, and preferably, the single-line drawn image is completely recorded before the plural-line drawn image is recorded. As a result, the time from the end of image erasing until the start of recording of a drawn image to be formed by a plurality of adjacent laser light drawn lines can be longer than when the drawn image to be formed by the plurality of adjacent laser light drawn lines is to be recorded first of all after the end of image erasing. That is, the drawn image to be formed by the plurality of adjacent laser light drawn lines can be recorded after the heat accumulated in the thermally reversible recording medium due to image erasing is cleared, which can make it less likely for degradation of the density of the drawn image, degradation of the readability of an information code, degradation of the repetition durability, and collapsing of characters and symbols to occur.

When it is said that the thermally reversible recording medium is cleared of a heat accumulated state, it means that recording sensitivity X1 of the thermally reversible recording medium and recording sensitivity X0 of a thermally reversible recording medium of which temperature is equal to the ambient temperature satisfy the following formula of $X1/1.1 \leq X1 \leq X0$. Here, recording sensitivity is the energy required for the image density to be higher than the background density by 1.0.

Figure 9A:
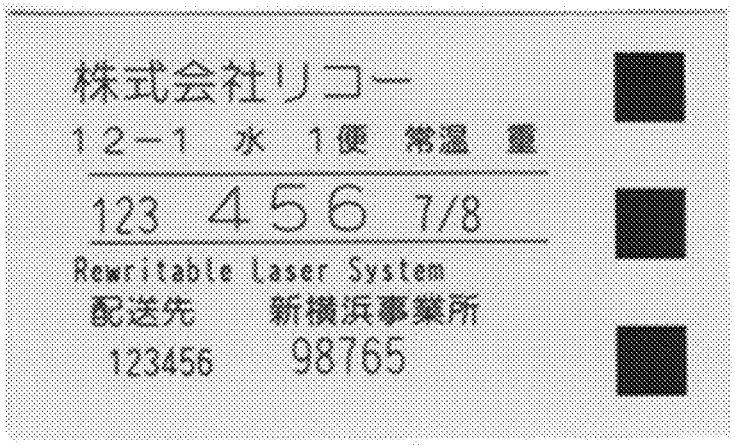
FIG. 9A is a schematic diagram showing an example image pattern used in Examples and Comparative Examples.
Figure 9B:
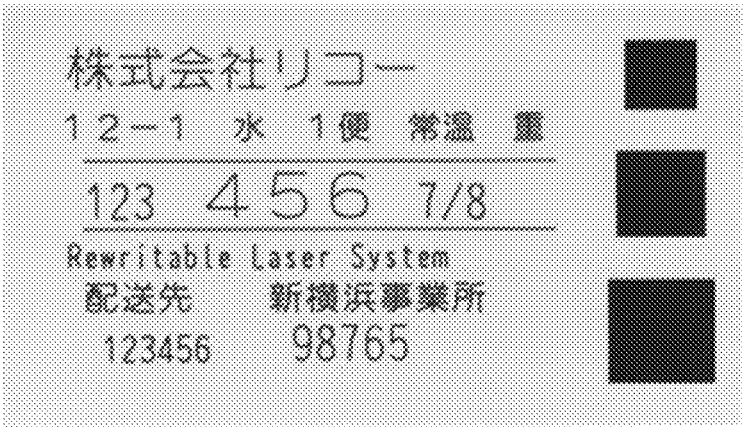
FIG. 9B is a schematic diagram showing an example image pattern used in Examples and Comparative Examples.
Figure 9C:
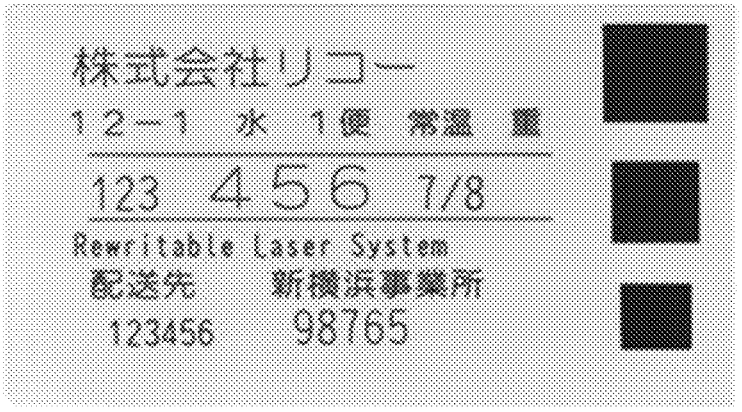
FIG. 9C is a schematic diagram showing an example image pattern used in Examples and Comparative Examples.
Figure 9D:
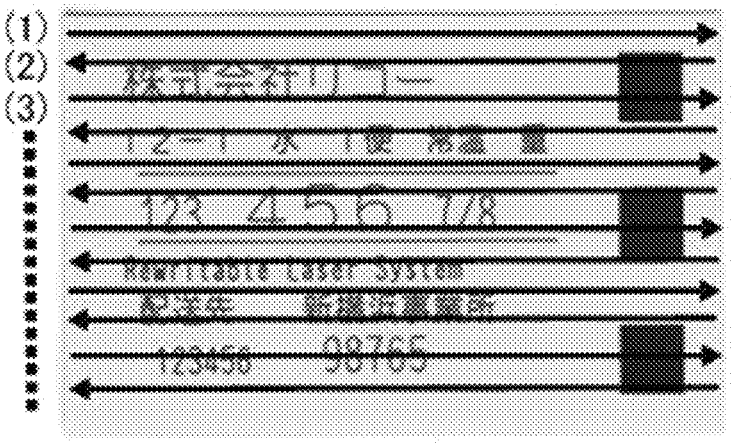
FIG. 9D is a schematic diagram showing an example erasing order in Examples and Comparative Examples.
Figure 9E:
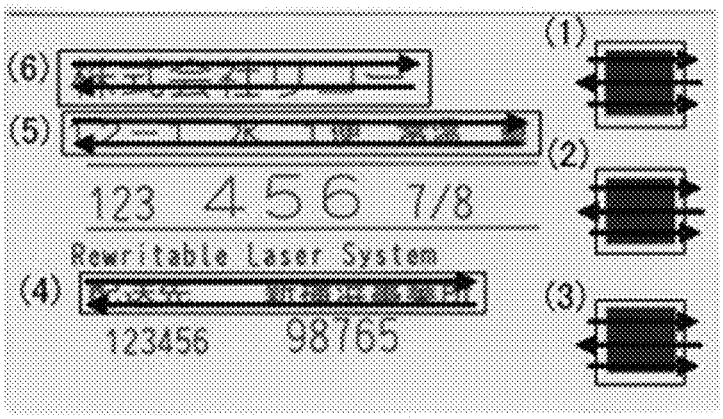
FIG. 9E is a schematic diagram showing an example erasing order in Examples and Comparative Examples.
Figure 9F:
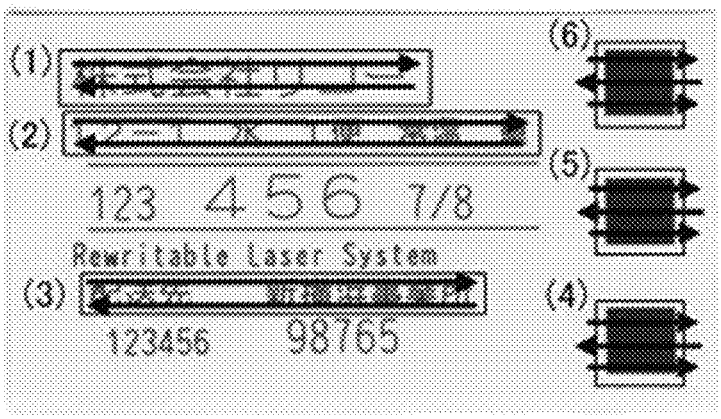
FIG. 9F is a schematic diagram showing an example erasing order in Examples and Comparative Examples.
Figure 9G:
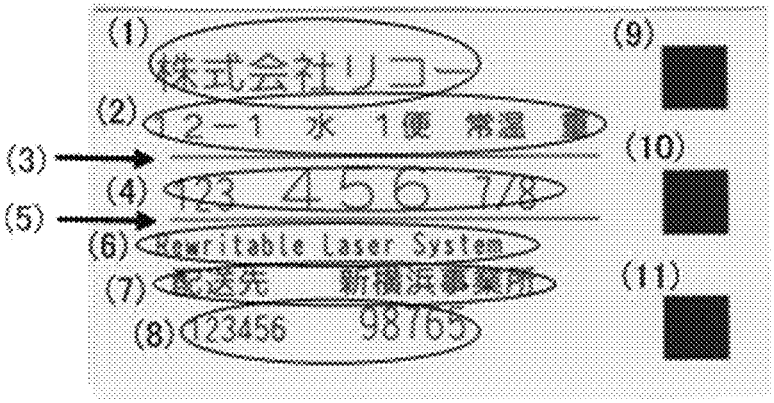
FIG. 9G is a schematic diagram showing an example recording order in Examples and Comparative Examples.

As for an image pattern shown in FIG. 9A, the image processing method of the first embodiment may be to perform image erasing in the image erasing order shown in FIG. 9D, and after this, perform image recording in the recording order [(1) to (11)] shown in FIG. 9G. In FIG. 9D and FIG. 9G, enclosure with a circle represents image recording, and enclosure with a frame together with arrows represent image erasing.

In the image recording step, it is preferable to record plural-line drawn images with smaller numbers of drawn lines earlier than other plural-line drawn images. This is because the more drawn lines a drawn image includes, the broader region of the thermally reversible recording layer of the thermally reversible recording medium will be heated to thereby make it harder for heat dissipation to occur from the heated region of the thermally reversible recording layer to the surrounding regions than when the drawn image includes a fewer drawn lines, to thereby result in slow cooling of the thermally reversible recording layer. If plural-line drawn images with a fewer drawn lines are recorded more previously, the time from the end of image erasing until the start of recording of any image with many drawn lines can be long, which can make it less likely for degradation of the density of the drawn image, degradation of the readability of an information code, degradation of the repetition durability, and collapsing of characters and symbols to occur.

In the image recording step, it is preferable to record a drawn image with a smaller area earlier than other plural-line drawn images. This is because the larger area a drawn image to be formed by a plurality of adjacent laser light drawn lines has, the broader region of the thermally reversible recording layer of the thermally reversible recording medium will be heated to thereby make it harder for heat dissipation to occur from the heated region of the thermally reversible recording layer to the surrounding regions than when the drawn image has a smaller area, to thereby result in slow cooling of the thermally reversible recording layer. If drawn images with smaller areas are recorded more previously, the time from the end of image erasing until the start of recording of any image with a large area can be long, which can make it less likely for degradation of the density of the drawn image, degradation of the readability of an information code, degradation of the repetition durability, and collapsing of characters and symbols to occur.

In the image processing method of the second embodiment, in the image erasing step before the image recording step is performed, a region to which a plural-line drawn image is to be recorded in the image recording step is completely erased, and after this, a region to which a single-line drawn image is to be recorded in the image recording step is at least partially erased.

It is more preferable that in the image erasing step before the image recording step is performed, the region to which a plural-line drawn image is to be recorded in the image recording step be completely erased, and after this, the region to which a single-line drawn image is to be recorded in the image recording step be completely erased. As a result, the time from the end of image erasing until the start of recording of a drawn image to be formed by a plurality of adjacent laser light drawn lines can be long, which can make it less likely for degradation of the density of the drawn image, degradation of the readability of an information code, degradation of the repetition durability, and collapsing of characters and symbols to occur.

The region to which a plural-line drawn image is to be recorded means the smallest region that encloses therewithin the plural-line drawn image to be recorded in the image recording step.

The region to which a single-line drawn image is to be recorded means the smallest region that encloses therewithin the single-line drawn image to be recorded in the image recording step.

To erase a region to which a plural-line drawn image is to be recorded means to at least partially erase the region to which the plural-line drawn image is to be recorded.

To erase a region to which a single-line drawn image is to be recorded means to at least partially erase the region to which the single-line drawn image is to be recorded.

The image processing method of the second embodiment may be, for example, to record the image pattern shown in FIG. 9A after erasing the image pattern shown in FIG. 9A, or to perform erasing in the erasing order shown in FIG. 9E [(1) to (6)]. In FIG. 9E, enclosure with a frame together with arrows represent image erasing.

In the image erasing step, it is preferable to erase a region to which a plural-line drawn image to be formed by a larger number of drawn lines is to be recorded earlier than other regions to which plural-line drawn images are to be recorded in the image recording step. This can earn a longer time from image erasing until image recording.

In the image erasing step, it is preferable to erase a region to which a plural-line drawn image with a larger area is to be recorded earlier than other regions to which plural-line drawn images are to be recorded in the image recording step. This can earn a longer time from image erasing until image recording.

In the image recording step, it is more preferable to make the recording order in the image recording step equal to the erasing order in the image erasing step. This can ensure some time to exist from image erasing to each region until image recording to that region, and hence can ensure heat dissipation, which can make it less likely for degradation of the density of the drawn image, degradation of the readability of an information code, etc. to occur. Further, unevenness of the time from image erasing until image recording can be suppressed. Therefore, the most heat-accumulated region can be suppressed from being excessively heated when image recording is performed in that region with a laser output that will provide a sufficient image density when an image is recorded in the least heat-accumulated region. This can make it less likely for degradation of the readability of an information code, degradation of the repetition durability, and collapsing of characters and symbols to occur.

When there are a region to which an image is to be recorded and a region to which no image is to be recorded in the image recording step, it is preferable to erase the region to which an image is to be recorded in the image recording step, and after this, at least partially erase the region to which no image is to be recorded in the image recording step. It is more preferable to erase the region to which an image is to be recorded in the image recording step, and after this, completely erase the region to which no image is to be recorded in the image recording step. As a result, a longer time from the end of image erasing until the start of image recording can be secured for a drawn image to be recorded in a region that has accumulated heat in the image erasing step, which can make it less likely for degradation of the density of the drawn image, degradation of the readability of an information code, degradation of the repetition durability, and collapsing of characters and symbols to occur.

When regions to which images are to be recorded in the image recording step include a region in which image erasing is performed in the image erasing step and a region in which image erasing is not performed in the image erasing step, it is preferable to perform the image recording step by recording an image to the region in which image erasing is not performed in the image erasing step, and after this, at least partially recording an image to the region in which image erasing is performed in the image erasing step. It is more preferable to record an image to the region in which image erasing is not performed in the image erasing step, and after this, completely record an image to the region in which image erasing is performed in the image erasing step. As a result, a longer time from the end of image erasing until the start of image recording can be secured for a drawn image to be recorded in a region that has accumulated heat in the image erasing step, which can make it less likely for degradation of the density of the drawn image, degradation of the readability of an information code, degradation of the repetition durability, and collapsing of characters and symbols to occur.

The time from when the image erasing step is completed until when the image recording step is started is not particularly limited and may be appropriately selected according to the purpose. However, it is preferably 400 ms or greater, more preferably 500 ms or greater, and yet more preferably 600 ms or greater. The upper limit thereof is not particularly limited and may be appropriately selected according to the purpose. However, it is preferably 1,000 ms or less.

When the time from when the image erasing step is completed until when the image recording step is started is less than 400 ms, the heat accumulated in the thermally reversible recording medium due to image erasing has not yet been cleared, which makes it likely for degradation of the density of the drawn image, degradation of the readability of an information code, degradation of the repetition durability, and collapsing of characters and symbols to occur. When the time from when the image erasing step is completed until when the image recording step is started is long, it may not be possible for a laser rewriting apparatus to realize a high throughput.

Clients of rewriting systems for rewriting a thermally reversible recording medium by pasting it on a shipping container used on a distribution line require processing of 1,500 shipping containers per hour, which means that the rewriting process needs to be completed in 2.4 seconds per shipping container. Actually, there are a time taken for a shipping container to arrive in front of the image recording apparatus and a stopping time, the total of both of which is 0.6 seconds. Therefore, the time left actually available is 1.8 seconds.

On this basis, it takes 1.1 seconds to erase an image from a label having a label size of (50 mm×80 mm) that is used on site, and it takes 0.6 seconds to record an image. Therefore, the time taken to shift from the image erasing to the image recording needs to be 0.1 seconds or less (100 ms or less).

<<Image Recording Step>>

The image recording step is a step of at least either irradiating a thermally reversible recording medium with laser light and heating the thermally reversible recording medium to thereby record thereon, a single-line drawn image to be formed by a single laser light drawn line, or irradiating the thermally reversible recording medium with laser light beams having certain intervals therebetween in parallel and heating the thermally reversible recording medium to thereby record thereon, a plural-line drawn image to be formed by a plurality of laser light drawn lines, and is performed by an image recording unit.

Here, the plural-line drawn image formed by a plurality of laser light drawn lines means, for example, images such as bold face, outline character, information code such as barcode and two-dimensional code such as QR code (Registered Trademark), and solid fill, which are formed by drawing a plurality of laser light drawn lines spaced apart at certain intervals.

Figure 5:
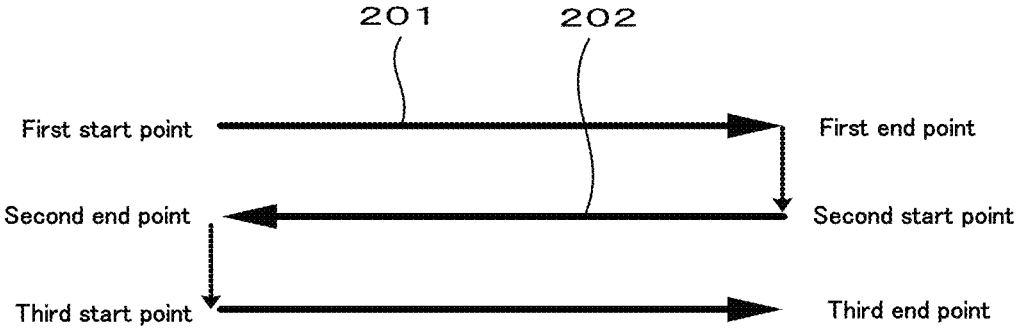
FIG. 5 is an exemplary diagram showing an example scanning method in an image processing method.
Figure 6:
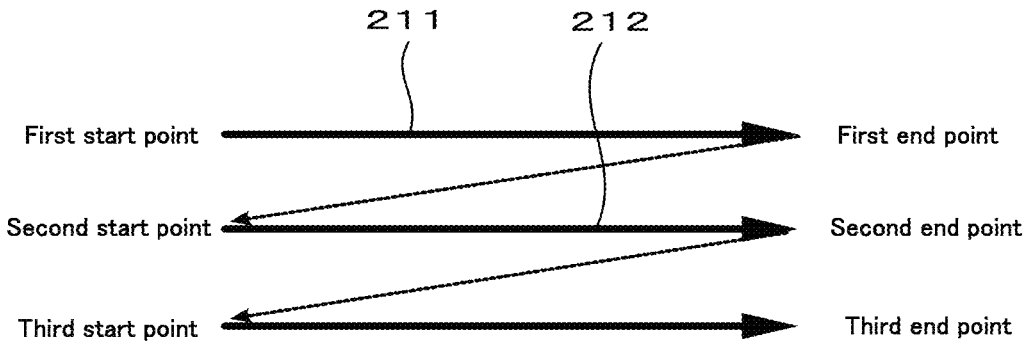
FIG. 6 is an exemplary diagram showing another example scanning method in an image processing method.
Figure 7:
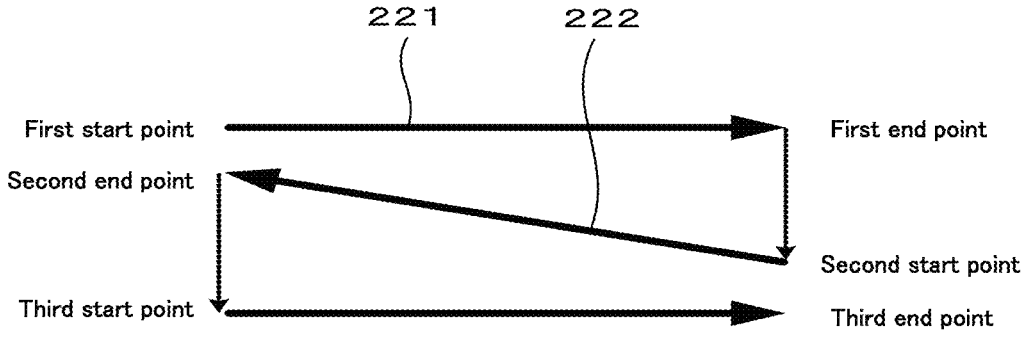
FIG. 7 is an exemplary diagram showing another example scanning method in an image processing method.

The laser light scanning method in the image recording using laser light may be those shown in FIG. 5, FIG. 6, and FIG. 7. In FIG. 5, FIG. 6, and FIG. 7, a solid-line arrow represents a laser drawing operation (marking operation), and a broken-line arrow represents a jumping operation (idle running operation) for shifting the drawing points.

FIG. 5 shows a method of emitting and scanning laser light so as to draw a first laser light drawn line 201 from a first start point to a first end point and draw a second laser light drawn line 202 adjacent to the first laser light drawn line 201 from a second start point to a second end point in parallel with the first laser light drawn line 201.

FIG. 6 shows a method of emitting and scanning laser light so as to draw a first laser light drawn line 211 from a first start point to a first end point, scan from the first end point to a second start point without emitting laser light, and draw a second laser light drawn line 212 adjacent to the first laser light drawn line 211 from the second start point to a second end point in parallel with the first laser light drawn line 211.

FIG. 7 shows a method of emitting and scanning laser light so as to draw a first laser light drawn line 221 from a first start point to a first end point, and draw a second laser light drawn line 222 adjacent to the first laser light drawn line 221 from a second start point to a second end point that is positioned on a line inclined from a line parallel with the first laser light drawn line 221 toward the first start point.

The scanning methods of FIG. 5 and FIG. 7 can realize a high throughput with a laser rewriting apparatus because the methods can reduce the image recording time. The scanning method of FIG. 6 can realize a high repetition durability because the method can eliminate heat accumulation at the line folding points and can prevent excessive heat from being applied to the thermally reversible recording medium.

The irradiation energy at the start point and the end point of a laser light drawn line is expressed by the following formula of P/(V*r), where P represents the power output of the laser light at the start point or the end point of the laser light drawn line in the image recording step, V represents the scanning velocity of the laser light at the start point or the end point of the laser light drawn line in the image recording step, and r represents the spot diameter of the laser light on the recording medium in a direction perpendicular to the scanning direction in the image recording step.

Meanwhile, the irradiation energy of a laser light drawn line as a line segment is expressed by the following formula of P/(V*r), where P represents the average power output of the laser light from the start point to the end point of the laser light drawn line in the image recording step, V represents the average scanning velocity of the laser light from the start point to the end point of the laser light drawn line in the image recording step, and r represents the spot diameter of the laser light on the recording medium in a direction perpendicular to the scanning direction in the image recording step.

The irradiation energy of laser light is expressed by the power output P, the scanning velocity V, and the spot diameter r of the laser light. The method for changing the irradiation energy of the laser light may be but is not limited to changing only P, changing only V, and changing only r. These methods for changing the energy density may be used alone, or may be used in combination.

Among these, preferable as the method for changing the irradiation energy of the laser light is changing P when changing the irradiation energy per laser light drawn line, and is changing V when changing the irradiation energy of each of the start point and the end point of the laser light drawn line.

The method for controlling the scanning velocity of the laser light is not particularly limited and may be appropriately selected according to the purpose. Examples thereof include a method of controlling the rotation speed of a motor that is in charge of actuating a scanning mirror.

The method for controlling the irradiation power of the laser light is not particularly limited and may be appropriately selected according to the purpose. Examples thereof include a method of changing the set value of the light irradiation power, and a control method based on adjustment of pulse time width in the case of a pulse irradiation laser.

Examples of the method for changing the set value of the light irradiation power include a method of changing the set value of the power depending on the recording regions. Examples of the control method based on the pulse time width include a method of changing the time width for which to emit a light pulse depending on the recording regions to thereby enable adjustment of the irradiation energy based on the irradiation power.

<<Image Erasing Step>>

The image erasing step is a step of irradiating the thermally reversible recording medium with laser light and heating the thermally reversible recording medium to thereby erase at least any of the single-line drawn image formed by a single laser light drawn line and the plural-line drawn image formed by a plurality of laser light drawn lines.

The laser light scanning method in the image erasing using laser light of a circular beam may be those shown in FIG. 5, FIG. 6, and FIG. 7. In FIG. 5, FIG. 6, and FIG. 7, a solid-line arrow represents a laser drawing operation (marking operation), and a broken-line arrow represents a jumping operation (idle running operation) for shifting the drawing points.

FIG. 5 shows a method of emitting and scanning laser light so as to draw a first laser light drawn line 201 from a first start point to a first end point and draw a second laser light drawn line 202 adjacent to the first laser light drawn line 201 from a second start point to a second end point in parallel with the first laser light drawn line 201.

FIG. 6 shows a method of emitting and scanning laser light so as to draw a first laser light drawn line 211 from a first start point to a first end point, scan from the first end point to a second start point without emitting laser light, and draw a second laser light drawn line 212 adjacent to the first laser light drawn line 211 from the second start point to a second end point in parallel with the first laser light drawn line 211.

FIG. 7 shows a method of emitting and scanning laser light so as to draw a first laser light drawn line 221 from a first start point to a first end point, and draw a second laser light drawn line 222 adjacent to the first laser light drawn line 221 from a second start point to a second end point that is positioned on a line inclined from a line parallel with the first laser light drawn line 221 toward the first start point.

In the image erasing step of erasing an image by irradiation and heating by laser light of a circular beam, it takes time to perform image erasing, because in order to perform image erasing uniformly, the entire surface of the thermally reversible recording medium is irradiated with the laser light, by spacing apart a plurality of laser light drawn light at certain intervals and overlaying them. Therefore, the scanning methods of FIG. 5 and FIG. 7 are preferable because the methods can reduce the image erasing time and hence can realize a high throughput of the laser rewriting apparatus. The method of FIG. 7 is further preferable because the method can reduce heat accumulation at the folding points and hence can realize a high repetition durability. The scanning method of FIG. 6 takes more time to perform image erasing than the scanning methods of FIG. 5 and FIG. 7, but can realize a high repetition durability because it can prevent excessive energy from being applied to the thermally reversible recording medium.

With the image erasing by the laser light scanning methods, it is possible to erase only a partial region of the thermally reversible recording medium. Therefore, only image information that is desired to be erased can be erased. Therefore, when information to be rewritten and information not to be rewritten are mixed, the time during which the laser light is emitted may be reduced in both of the image erasing step and the image recording step, as compared with when the entire surface of the thermally reversible recording medium is to be erased, which may result in improved throughput. Further, the erasing order in the image erasing step can be controlled. Therefore, if the order to erase a region to which a drawn image to be formed by a plurality of adjacent laser light drawn lines is to be recorded which is susceptible to heat accumulation is expedited, a recorded image having a high visibility, a recorded image having a high computer readability, and an image having excellent repetition durability can be recorded.

The method for controlling the scanning speed of the laser light is not particularly limited and may be appropriately selected according to the purpose. Examples thereof include a method of controlling the rotation speed of a motor that is in charge of actuating a scanning mirror.

The power output of the laser light to be emitted in the image erasing is not particularly limited and may be appropriately selected according to the purpose. However, it is preferably 5 W or greater, more preferably 7 W or greater, and yet more preferably 10 W or greater. When the power output of the laser light is less than 5 W, it takes time to perform image erasing, and the power output will run out if an attempt is made to complete image erasing in a short time to thereby cause an image erasing error. The upper limit of the power output of the laser light is not particularly limited and may be appropriately selected according to the purpose. However, it is preferably 200 W or less, more preferably 150 W or less, and yet more preferably 100 W or less. When the power output of the laser light is greater than 200 W, upsizing of the laser apparatus may be necessitated.

The scanning velocity of the laser light to be emitted in the image erasing step is not particularly limited and may be appropriately selected according to the purpose. However, it is preferably 100 mm/s or greater, more preferably 200 mm/s or greater, and yet more preferably 300 mm/s or greater. When the scanning velocity is less than 100 mm/s, it takes time to perform image erasing. The upper limit of the scanning velocity of the laser light is not particularly limited and may be appropriately selected according to the purpose. However, it is preferably 20,000 mm/s or less, more preferably 15,000 mm/s or less, and yet more preferably 10,000 mm/s or less. When the scanning velocity is greater than 20,000 mm/s, it may be difficult to perform uniform image erasing.

The laser light source is not particularly limited and may be appropriately selected according to the purpose. However, the laser light source is preferably at least any of YAG laser light, fiber laser light, and laser diode light.

The spot diameter of the laser light to be emitted in the image erasing step is not particularly limited and may be appropriately selected according to the purpose. However, it is preferably 1 mm or greater, more preferably 2.0 mm or greater, and yet more preferably 3.0 mm or greater. The upper limit of the spot diameter of the laser light is not particularly limited and may be appropriately selected according to the purpose. However, it is preferably 20.0 mm or less, more preferably 16.0 mm or less, and yet more preferably 12.0 mm or less.

When the spot diameter is small, it takes time to perform image erasing. When the spot diameter is large, the power output may run out to cause an image erasing error.

The image processing apparatus is basically the same as a so-called laser marker, except that it includes at least the laser light emitting unit and the laser light scanning unit, and it includes an oscillator unit, a power source control unit, a program unit, etc.

(Conveyor System)

A conveyor system of the present invention incorporates therein at least any of the image processing apparatus of any of the first embodiment and the second embodiment of the present invention and the image processing method of any of the first embodiment and the second embodiment of the present invention, so that image processing may be performed based on information from the conveyor system.

It is preferable that image information to be rewritten with the conveyor system include at least barcode information, and that immediately after the rewriting, barcode reading be performed.

A preferable method for employing the image processing apparatus and the image processing method of the present invention is to incorporate them into a conveyor system using boxes that require managing, as opposed to recyclable boxes. When information necessary for display is transferred to the image processing apparatus by the conveyor system, it becomes ready for image rewriting to be performed contactlessly to the thermally reversible recording medium pasted on the box, which eliminates the necessity of detaching, pasting, and peeling of the thermally reversible recording medium, to thereby enable efficient running.

The image information to be rewritten with the conveyor system commonly includes barcode information, in order for the information on the box to be read at high speed. Because of the nature of the conveyor system, in order to confirm whether image rewriting can be performed properly, it is necessary to perform barcode reading immediately after image rewriting to confirm that the image rewriting has been performed properly.

Meanwhile, there is a problem that a thermally reversible recording medium has a low color optical density immediately after recording, and there is a risk of a reading error when the barcode is read immediately after it is recorded. This problem is particularly remarkable under low temperature conditions. However, it has been found out that the color optical density can be high even immediately after recording, if the recording is performed to the thermally recording medium that is under heat after erasing. There has also been a problem due to vibration of the box conveyed by the conveyor, which persists even after the box is stopped in front of the image processing apparatus and would cause a barcode reading error, because a barcode image cannot be recorded properly if formed under the vibration, leading to degradation of the processing performance due to waiting until attenuation of the vibration. According to the rewriting of the present invention, the first action after the box is stopped is an erasing process. During this erasing process, the vibration of the box attenuates, and at the time of forming a barcode, it becomes possible to form a barcode image without any influence of vibration. Even when an operation is performed at high speed under low temperature conditions, employment of the image processing apparatus and the image processing method of the present invention makes it possible to perform recording under a heated state immediately after erasing and under a vibration attenuated state, to thereby make it possible to form a barcode that has a high color optical density even immediately after rewriting and includes no disturbance due to vibration. Such a barcode is suitable for reading.

Rewriting was performed under low temperature conditions of 8° C. at a rate of 1,500 media per time, and a reading test by a barcode scanner was performed 1 second after the image including a barcode was formed. As a result, with the technique of the present invention, there occurred no reading error when 2,000 media had been read. On the other hand, with a conventional system in which erasing and recording were performed separately, there occurred 2 reading errors when 2,000 media had been read.

<Thermally Reversible Recording Medium>

The thermally reversible recording medium includes a support member, and a thermally reversible recording layer on the support member, and further includes other layers appropriately selected according to necessity, such as a first oxygen barrier layer, a second oxygen barrier layer, an ultraviolet absorbing layer, a back layer, a protection layer, an intermediate layer, an undercoat layer, an adhesive layer, an agglutinative layer, a colorant layer, an air layer, and a light reflecting layer. These layers may be a single-layer structure or a multi-layer structure. However, in order to save energy loss of the laser light to be emitted having a specific wavelength, a layer to be provided on a photothermic layer is preferably made of a material that has little absorption at that specific wavelength.

Figure 2:
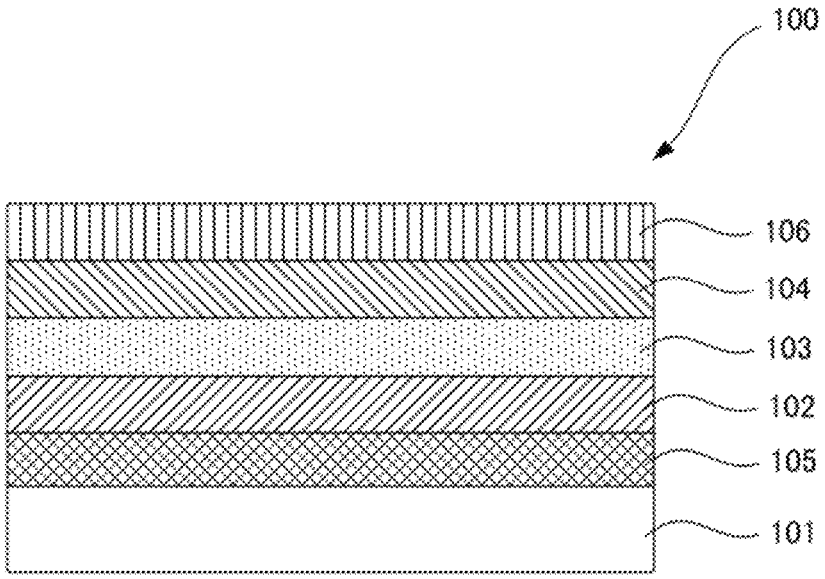
FIG. 2 is a schematic cross-sectional diagram showing an example layer structure of a thermally reversible recording medium.

The layer structure of the thermally reversible recording medium 100 may include, as shown in FIG. 2, a hollow and a thermally reversible recording layer 102 on (a support member+a first oxygen barrier layer) 101, and an intermediate layer 102, a second oxygen barrier layer 104, and an ultraviolet absorbing layer 106 on the thermally reversible recording layer.

—Support Member—

The shape, structure, size, etc. of the support member are not particularly limited and may be appropriately selected according to the purpose. The shape may be, for example a flat panel shape. The structure may be a single-layer structure or a multi-layer structure. The size may be appropriately selected according to the size, etc. of the thermally reversible recording medium.

—Thermally Reversible Recording Medium—

The thermally reversible recording layer (hereinafter may be referred to as "thermally reversible recording layer") is a thermally reversible recording layer that contains a leuco dye which is an electron-donating color-producing compound, and a developer which is an electron accepting compound, of which color tone changes reversibly due to heat, and that further includes a binder resin and other components according to necessity.

The leuco dye that is an electron-donating color-producing compound of which color tone reversibly changes due to heat, and a reversible developer that is an electron accepting compound are materials that can express a phenomenon in which visibly-noticeable reversible changes occur along with temperature changes, and can change to a relatively color-developed state and a color-faded state.

—Leuco Dye—

The leuco dye is a dye precursor that is by itself colorless or pale. The leuco dye is not particularly limited and may be appropriately selected from those publicly known. Preferable examples thereof include leuco components of triphenylmethanephthalide-based, triallylmethane-based, fluoran-based, phenothiazine-based, thiopheloran-based, xanthene-based, indophthalyl-based, spiropyran-based, azaphthalide-based, chromenopyrazole-based, methine-based, rhodamineanilinolactam-based, rhodaminelactam-base, quinazoline-based, diazaxanthene-based, and bislactone-based. Among these, leuco dyes of fluoran-based or phthalide-based are particularly preferable because they are excellent in color developing/fading characteristic, hue, and storage stability.

—Reversible Developer—

The reversible developer is not particularly limited and may be appropriately selected according to the purpose, as long as it can realize reversible color developing/fading based on a heat factor. Preferable examples thereof include a compound that contains in the molecule, one unit or more of the structure selected from (1) a structure that has a color developing characteristic of causing the leuco dye to develop color (e.g., phenol-based hydroxyl group, carboxylic group, and phosphoric group) and (2) a structure that controls cohesive force between molecules (e.g., a structure of long-chain hydrocarbon groups being linked). A divalent or higher linking group containing a hetero atom may intermediate between the linked sites. Further, at least any of a similar linking group and an aromatic group may be contained in the long-chain hydrocarbon group.

Phenol is particularly preferable as the structure that has a color developing characteristic of causing the leuco dye to develop color.

As the structure that controls cohesive force between molecules, a long-chain hydrocarbon group having 8 or more carbon atoms is preferable. The number of carbon atoms of the long-chain hydrocarbon group is more preferably 11 or more. The upper limit of the number of carbon atoms is preferably 40 or less, and more preferably 30 or less.

It is preferable to use in combination with the electron accepting compound (developer), a compound that contains in the molecule, at least one —NHCO— group and at least one —OCONH— group, as a decolorization promoter, because use thereof would improve the color developing/fading characteristic because an intermolecular interaction is induced between the decolorization promoter and the developer in the process of forming a color-faded state.

The decolorization promoter is not particularly limited and may be appropriately selected.

A binder resin, and according to necessity, various additives may be used in the thermally reversible recording layer in order to improve and control the coating characteristic and the color-developing/fading characteristic of the thermally reversible recording layer. Examples of the additives include surfactant, electro-conductive agent, filler, antioxidant, light stabilizer, color development stabilizer, and decolorization promoter.

—Binder Resin—

The binder resin is not particularly limited and may be appropriately selected according to the purpose, as long as it can bind the thermally reversible recording layer to the support member, and may be one resin selected from conventionally known resins or a mixture of two or more resins selected from conventionally known resins. Among these, preferable in order to improve the repetition durability are resin that is curable with heat, ultraviolet, electron beam, etc., and particularly, thermosetting resin in which an isocyanate-based compound or the like is used as a cross-linking agent.

—Photothermic Material—

A photothermic material is a material that, when added in the thermally reversible recording layer, performs a function of absorbing laser light with high efficiency and thereby generating heat. The photothermic material is added according to the wavelength of the laser light.

The photothermic material is roughly classified into inorganic material and organic material.

Examples of the inorganic material include metal or metalloid such as carbon black, Ge, Bi, In, Te, Se, and Cr, and alloy that contains any of these. These materials are formed into a layer state by vacuum vapor deposition or by bonding particles of these materials with a resin.

As the organic material, various dyes may be appropriately used according to the wavelength of the light to be absorbed. When a laser diode is used as the light source, a near-infrared absorbing pigment that has an absorption peak within a wavelength range of from 700 nm to 1,500 nm is used. Specific examples thereof include cyanine pigment, quinone-based pigment, quinoline derivative of indonaphtol, phenylenediamine-based nickel complex, and phthalocyanine-based compound. To allow repetitive image processing, it is preferable to select a photothermic material that has excellent heat resistance. In terms of this, a phthalocyanine-based compound is particularly preferable.

As the near-infrared absorbing pigment, one of the above may be used alone, or two or more of the above may be used in combination.

In the case of providing the photothermic layer, the photothermic material is typically used in combination with a resin. The resin to be used in the photothermic layer is not particularly limited and may be appropriately selected from those publicly known, as long as it can retain the inorganic material and the organic material. Preferable examples thereof include thermoplastic resin and thermosetting resin. The same resin as the binder resin used in the recording layer may be preferably used. Among these, preferable in order to improve the repetition durability are resin that is curable with heat, ultraviolet, electron beam, etc., and particularly, thermosetting resin in which an isocyanate-based compound or the like is used as a cross-linking agent.

—First and Second Oxygen Barrier Layers—

It is preferable to provide the first and second oxygen barrier layers above and under first and second thermally reversible recording layers in order to prevent oxygen from entering the thermally reversible recording layers to thereby prevent light degradation of the leuco dye included in the first and second thermally reversible recording layers. That is, it is preferable to provide the first oxygen barrier layer between the support member and the first thermally reversible recording layer and provide the second oxygen barrier layer above the second thermally reversible recording layer.

—Protection Layer—

The thermally reversible recording medium of the present invention preferably includes a protection layer on the thermally reversible recording layer in order to protect the thermally reversible recording layer. The protection layer is not particularly limited and may be appropriately selected according to the purpose. The protection layer may be provided on one or more layers. The protection layer is preferably provided on the exposed outermost surface.

—Ultraviolet Absorbing Layer—

In the present invention, it is preferable to provide an ultraviolet absorbing layer on a side of the thermally reversible recording medium opposite to the support member side thereof, in order to prevent the leuco dye in the thermally reversible recording medium from being colored due to ultraviolet and prevent a portion from being unerased due to light degradation. Provision thereof would improve light resistance of the recording medium. It is preferable to appropriately select the thickness of the ultraviolet absorbing layer so as for the ultraviolet absorbing layer to absorb ultraviolet of 390 nm or shorter.

—Intermediate Layer—

In the present invention, it is preferable to provide an intermediate layer between the thermally reversible recording layer and the protection layer, in order to improve adhesiveness between them, prevent changes of properties of the thermally reversible recording layer due to coating with the protection layer, and to prevent migration of an additive in the protection layer into the thermally reversible recording layer. Provision thereof would improve storage stability of a color developed image.

—Undercoat Layer—

In the present invention, it is possible to provide an undercoat layer between the thermally reversible recording layer and the support layer in order to provide a higher sensitivity based on effective utilization of applied heat, or in order to improve adhesiveness between the support member and the thermally reversible recording layer and prevent penetration of the recording layer material into the support member.

The undercoat layer contains at least hollow particles, contains a binder resin, and further contains other components according to necessity.

—Back Layer—

In the present invention, it is possible to provide a back layer on a side of the support layer opposite to the side thereof on which the thermally reversible recording layer is provided, in order to prevent curling and charge buildup of the thermally reversible recording medium and improve conveying convenience.

The back layer contains at least a binder resin, and further contains other components such as filler, electro-conductive filler, lubricant, and coloring pigment according to necessity.

—Adhesive Layer or Agglutinative Layer—

In the present invention, it is possible to provide a thermally reversible recording label by providing an adhesive layer or an agglutinative layer on a surface of the support member opposite to the surface thereof on which the thermally reversible recording layer is formed. The material of the adhesive layer or the agglutinative layer may be those used commonly.

<Image Recording/Image Erasing Mechanism>

The image recording/image erasing mechanism is a mode of reversibly changing color tones by heat. This mode is constituted by a leuco dye and a reversible developer (hereinafter may also be referred to as "developer"). In this mode, color tones reversibly change between a transparent state and a color developed state by heat.

Figure 3A:
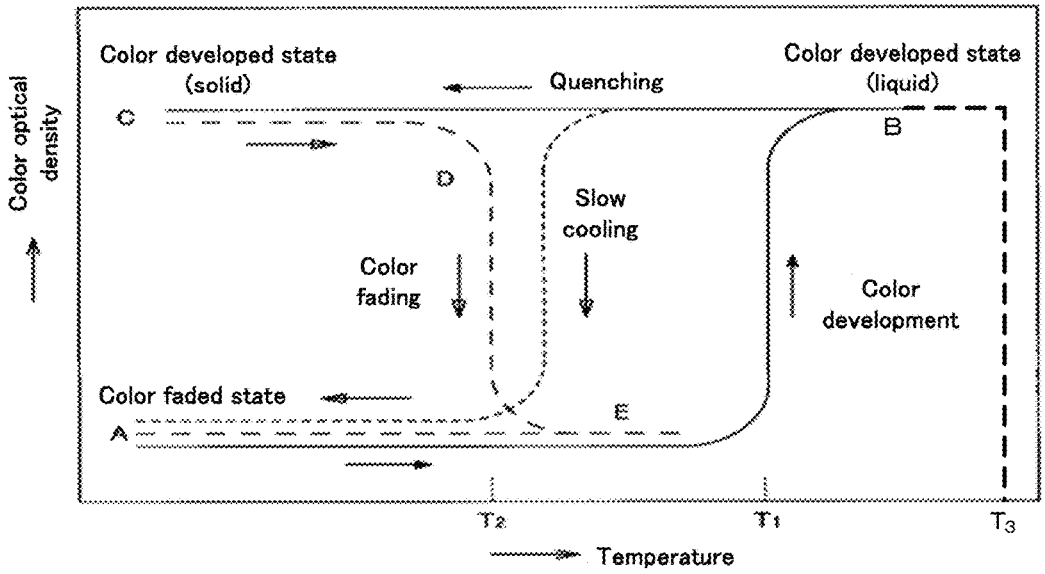
FIG. 3A is a graph showing a color developing-color fading characteristic of a thermally reversible recording medium.
Figure 3B:
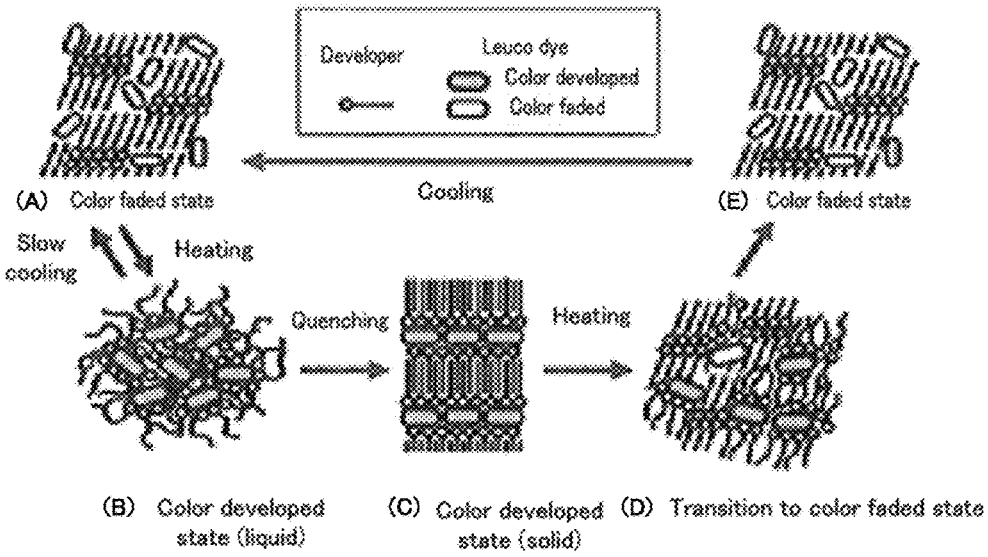
FIG. 3B is a schematic explanatory diagram showing a mechanism of color developing and color fading changes of a thermally reversible recording medium.

FIG. 3A shows an example temperature vs. color optical density change curve of a thermally reversible recording medium that includes a thermally reversible recording layer composed of the resin in which the leuco dye and the developer are contained. FIG. 3B shows a color developing and fading mechanism of the thermally reversible recording medium, of which transparent state and color developed state are changed to each other reversibly by heat.

First, as the recording layer that is initially in a color faded state (A) is warmed, the leuco dye and the developer melt and mix with each other at a melting temperature T1, and the layer develops a color and becomes a melt color developed state (B). By quenching the layer from the melt color developed state (B), it is possible to cool the layer to room temperature while keeping it in the color developed state, to thereby bring the layer into a secure color developed state (C) in which the color developed state is stabilized. Whether this color developed state can be obtained or not depends on the temperature lowering rate of lowering the temperature from the melt color developed state. Through slow cooling, color fading occurs in the process of lowering the temperature, to thereby bring about the same color faded state (A) as the initial state, or a state in which the density is relatively lower than that of the color developed state (C) obtained by quenching. When the layer is warmed again from the color developed state (C), color fading occurs (from D to E) at a temperature T2 lower than the temperature at which color development occurs. When the layer is cooled from this state, it returns to the same color faded state (A) as the initial state.

The color developed state (C) obtained by quenching from the melt state is a state in which the leuco dye molecules and the developer molecules have been mixed to be able to cause a contact reaction, in which state they often form a solid state. In this state, the molten mixture (i.e., the color developed mixture) of the leuco dye and the developer has crystallized while being kept in the color developed state. When this state is formed, it can be considered that the color development has been stabilized. On the other hand, a color faded state is a state in which the leuco dye and the developer are phase-separated. This state is a state in which the molecules of at least one compound have aggregated and formed a domain or have crystallized, and is considered to be a state in which the leuco dye and the developer have been stabilized as separated from each other through the aggregation or crystallization. In many cases, a more complete color fading occurs when, like this, the leuco dye and the developer have phase-separated and the developer has crystallized.

In both of color fading by slow cooling from the melt state and color fading by warming from the color developed state shown in FIG. 3A, the aggregation structure changes at the temperature T2, and phase separation or crystallization of the developer occurs.

Further, in FIG. 3A, after the recording layer has been repeatedly warmed to a temperature T3 equal to or higher than the melting temperature T1, it might cause an erasing error of not being able to be erased by being heated to the erasing temperature. This is considered to be because the developer has thermally decomposed to become less easily aggregable or crystallizable to thereby become less easily separable from the leuco dye. In order to prevent deterioration of the thermally reversible recording medium due to repeating, it may be good to make the difference between the melting temperature T1 and the temperature T3 shown in FIG. 3A small when heating the thermally reversible recording medium. This can realize prevention of deterioration of the thermally reversible recording medium due to repeating.

Figure 4:
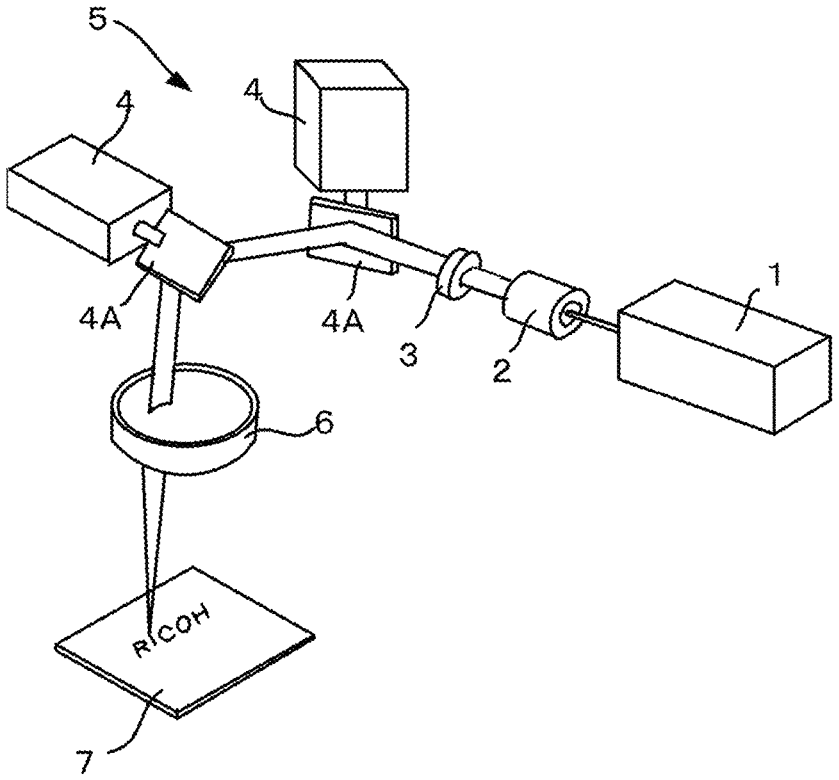
FIG. 4 is a schematic diagram showing another example image processing apparatus (laser marker apparatus) of the present invention.

FIG. 4 is a schematic diagram showing an example image processing apparatus of the present invention. This image processing apparatus includes a laser oscillator 1, a collimator lens 2, a focus position control mechanism 3, and a scanning unit 5. In FIG. 4, a reference sign 6 denotes a protection glass.

The laser oscillator 1 is necessary for obtaining laser light having a high light intensity and high directivity. Only beams of light in the optical path direction are selectively amplified, to thereby have improved directivity and be emitted as laser light from an output mirror.

The scanning unit 5 includes galvano meters 4 and mirrors 4A mounted on the galvano meters 4. The two mirrors 4A in the X axis direction and Y axis direction that are mounted on the galvano meters 4 scan the laser light output by the laser oscillator 1 while being rotated at high speed, to thereby perform image recording and image erasing onto a thermally reversible recording medium 7.

The power source control unit includes a light source driving power source configured to excite laser medium, a driving power source for the galvano meters, a cooling power source such as a Peltier device, a control unit configured to control the whole image processing apparatus, etc.

The program unit is a unit that, by means of touch panel inputting or keyboard inputting, allows for inputting conditions such as laser light intensity and laser scanning velocity, and creating and editing characters, etc. to be recorded, in order to realize image recording or erasing.

The laser irradiation unit, i.e., an image recording/erasing head is mounted on the image processing apparatus. In addition, the image processing apparatus includes a conveying member for the thermally reversible recording medium and a control unit therefore, a monitor unit (touch panel), etc.

An image erasing apparatus of the present invention is capable of repeatedly erasing images from a thermally reversible recording medium such as a label pasted on a shipping container such as cardboard box and plastic container in a contactless manner. Hence, it can preferably used in a distribution system. In this case, it is possible to record an image to or erase an image from the label while moving the cardboard box or the plastic container set on a belt conveyor, and to reduce the time taken for shipping because it is unnecessary to stop the line. Furthermore, it is possible to bring the cardboard box and the plastic container on which the label is pasted to image erasing and image recording again by recycling them as they are without peeling the label.

EXAMPLES

Examples of the present invention will be explained below. However, the present invention is not to be limited to these Examples by any means.

Manufacture Example 1

Manufacture of Thermally Reversible Recording Medium

A thermally reversible recording medium of which color tone changes reversibly due to heat was manufactured according to the method described below.

—Support Member—

A white polyester film (TETORON (Registered Trademark) FILM U2L98W manufactured by Teijin DuPont Films Japan Limited) having an average thickness of 125 μm was prepared as the support member.

—Formation of First Oxygen Barrier Layer—

A urethane-based adhesive (TM-567 manufactured by Toyo-Morton, Ltd.) (5 parts by mass), isocyanate (CAT-RT-37 manufactured by Toyo-Morton, Ltd.) (0.5 parts by mass), and ethyl acetate (5 parts by mass) were stirred well to thereby prepare an oxygen barrier layer coating liquid.

Next, a silica-vapor-deposited PET film (TECHBARRIER HX manufactured by Mitsubishi Plastics, Inc., oxygen permeability: 0.5 mL/m$^2$/day/Mpa) was coated with the oxygen barrier layer coating liquid with a wire bar, and heated and dried at 80° C. for 1 minute. This oxygen barrier layer-affixed silica-vapor-deposited PET film was pasted onto the support member and heated at 50° C. for 24 hours to thereby form a first oxygen barrier layer having a thickness of 12 μm.

—Undercoat Layer—

A styrene-butadiene-based copolymer (PA-9159 manufactured by Nippon A&L Inc.) (30 parts by mass), a polyvinyl alcohol resin (POVAL PVA103 manufactured by Kuraray Co., Ltd.) (12 parts by mass), hollow particles (MICROSPHERE R-300 manufactured by Matsumoto Yushi-Seiyaku Co., Ltd.) (20 parts by mass), and water (40 parts by mass) were added together and stirred for 1 hour until they became uniform, to thereby prepare an undercoat layer coating liquid.

Next, the support member was coated with the obtained undercoat layer coating liquid with a wire bar, and heated and dried at 80° C. for 2 minutes, to thereby form an undercoat layer having an average thickness of 20 μm.

—Formation of Thermally Reversible Recording Layer—

A reversible developer represented by the structural formula (1) below (5 parts by mass), 2 kinds of decolorization promoters represented by the structural formulae (2) and (3) (0.5 parts by mass each), an acrylic polyol 50% by mass solution (hydroxyl value=200 mgKOH/g) (10 parts by mass), and methyl ethyl ketone (80 parts by mass) were pulverized and dispersed with a ball mill until the average particle diameter became about 1 μm.

<Structural Formula (1)>

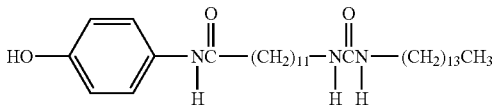

<Structural Formula (2)>

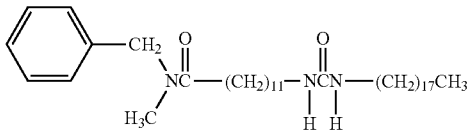

$C_{17}H_{35}CONHC_{18}H_{37}$ <Structural Formula (3)>

Next, 2-anilino-3-methyl-6 dibutylaminofluoran as the leuco dye (1 part by mass), isocyanate (CORONATE HL manufactured by Nippon Polyurethane Industry Co., Ltd.) (5 parts by mass), a tungsten oxide dispersion liquid as the photothermic material (manufactured by Sumitomo Metal Mining, Co., Ltd.) (1.4 parts by mass) were added to a dispersion liquid in which the reversible developer was pulverized and dispersed, and stirred well to thereby prepare a thermally reversible recording layer coating liquid.

The first oxygen barrier layer was coated with the obtained thermally reversible recording layer coating liquid with a wire bar, dried at 100° C. for 2 minutes, and after this, cured at 60° C. for 24 hours, to thereby form a thermally reversible recording layer having a thickness of 12.0 μm.

—Formation of Second Oxygen Barrier Layer—

The same oxygen-barrier-layer-affixed silica-vapor-deposited PET film as the first oxygen barrier layer was pasted on the ultraviolet absorbing layer, heated at 50° C. for 24 hours, to thereby form a second oxygen barrier layer having a thickness of 12 μm.

—Formation of Ultraviolet Absorbing Layer—

An ultraviolet absorbing polymer 40% by mass solution (UV-G300 manufactured by Nippon Shokubai Co., Ltd.) (10 parts by mass), isocyanate (CORONATE HL manufactured by Nippon Polyurethane Industry Co., Ltd.) (1.5 parts by mass), and methyl ethyl ketone (12 parts by mass) were added together, and stirred well to thereby prepare an ultraviolet absorbing layer coating liquid.

Next, the thermally reversible recording layer was coated with the ultraviolet absorbing layer coating liquid with a wire bar, heated and dried at 90° C. for 1 minutes, and after this, heated at 60° C. for 24 hours, to thereby form an ultraviolet absorbing layer having a thickness of 1 μm.

—Formation of Back Layer—

Pentaerythritol hexaacrylate (KAYARAD DPHA manufactured by Nippon Kayaku Co., Ltd.) (7.5 parts by mass), urethane acrylate oligomer (ARTRESIN UN-3320HA manufactured by Negami Chemical Industrial Co., Ltd.) (2.5 parts by mass), acicular electro-conductive titanium oxide (FT-3000 manufactured by Ishihara Sangyo Kaisha Ltd., longer axis=5.15 μm, shorter axis=0.27 μm, composition:

titanium oxide coated with antimony-doped tin oxide) (2.5 parts by mass), photopolymerization initiator (IRGACURE 184 manufactured by Nihon Ciba-Geigy K.K.) (0.5 parts by mass), and isopropyl alcohol (13 parts by mass) were added together, and stirred with a ball mill, to thereby prepare a back layer coating liquid.

Next, a surface of the support layer on which the thermally reversible recording layer, etc. were not formed was coated with the back layer coating liquid with a wire bar, heated and dried at 90° C. for 1 minute, and after this, cross-linked with an ultraviolet lamp of 80 W/cm, to thereby form a back layer having a thickness of 4 μm. In this way, the thermally reversible recording medium of Manufacture Example 1 was manufactured.

Example 1

The thermally reversible recording medium of Manufacture Example 1 was used, and as shown in FIG. 1, an optical system was formed by arranging a fiber-coupled LD (laser diode) light source (PLD 60 manufactured by IPG Photonics Corporation, central wavelength: 974 nm, maximum power output: 60 W) as the laser light source 11, arranging the collimator lens 12*b* immediately after the fiber for collimating the beam to parallel light, and arranging the focal length control unit 16 and the condensing lens 18. After this, image processing was performed with a LD marker apparatus that was configured to irradiate the thermally reversible recording medium with laser light by scanning the laser light with a galvano scanner 6230H manufactured by Cambridge Inc.

<Initial Settings>

The thermally reversible recording medium was fixed with the LD marker apparatus such that the work distance from the surface of the optical head to the thermally reversible recording medium would be 150 mm, and the beam diameter was adjusted with the focal length control unit 17 such that the beam diameter would be the minimum on the thermally reversible recording medium. Here, the work distance means the distance between the laser light emitting surface of the laser light emitting unit and the thermally reversible recording medium.

In order to perform rewriting to a 50 mm×85 mm region of the thermally reversible recording medium, image information including a barcode, scanning velocity of 6,000 mm/s, and irradiation power settings of 60 W as peak power setting and 42% as pulse width (i.e., 23.9 W when converted to power output on the thermally reversible recording medium) were input as image recording information from the information setting unit of the image setting unit. A work distance of 150 mm was input as distance information between the laser light emitting surface of the laser light emitting unit and the thermally reversible recording medium. Further, a region of 45 mm×80 mm, scanning velocity of 3,300 mm/s, pitch width of 1.0 mm, and irradiation power settings of 60 W as peak power setting and 92% as pulse width (i.e., 52.4 W when converted to power output on the thermally reversible recording medium) were input as image erasing information from the information setting unit. The image erasing information, the image recording information, and the distance information were input and set by means of the information setting unit, such that they would be operated with one control file.

A thermister 103ET-1 manufactured by Semitec Corporation was used as an ambient temperature sensor.

A displacement sensor HL-G112-A-C5 manufactured by Panasonic Industrial Devices SUNX Co., Ltd. was used as a distance sensor.

<Image Erasing>

The ambient temperature during image erasing was 25° C. While the ambient temperature sensor and the distance sensor were both set to OFF, erasing was performed by setting the work distance to 81 mm with the focal length control unit such that the beam diameter on the thermally reversible recording medium would be 6.0 mm. The time taken for the image erasing only was 1.14 seconds.

<Image Recording>

The ambient temperature during image recording was 25° C. While the ambient temperature sensor and the distance sensor were both set to OFF, recording was performed with a beam diameter on the thermally reversible recording medium of 0.48 mm. The time taken for the image recording only was 0.48 mm.

<Image Processing>

In Example 1, the rewriting time from the start of the image erasing step until the end of the image recording step was 1.75 seconds.

Barcode grade evaluation was performed on the thermally reversible recording medium of Example 1 on which a barcode image was formed according to the following manner. The results are shown in Tables 1.

<Barcode Image Grade Evaluation>

Barcode image grade evaluation is a value to be obtained by measurement with a barcode verifier TRUCHECK TC401RL manufactured by Webscan Inc. With this, barcode quality is measured and graded according to a method compliant with ISO-15416 standard. The grades are 5 stages of A, B, C, D, and F. The best grade is A, the next best is B, and then C, D, and F. The grades A to C are the range of non-problematic levels as barcode reader readability. There are also level gradations in each grade, with grade A of from 3.5 to 4.0, grade B of from 2.5 to 3.4, grade C of from 1.5 to 2.4, grade D of from 0.5 to 1.4, and grade F of 0.4 or less. At the grade D, there would occur rarely that the barcode will not be able to be read by a barcode reader having a poor reading ability. At the grade F, there will frequently occur that the barcode will not be able to be read. Therefore, the grade of a barcode is preferably C or greater, in order to secure stable readability with a barcode reader.

Example 2

Image recording was performed under the same conditions as Example 1, except that the medium position was set at the work distance of 147 mm unlike Example 1, and barcode grade valuation was performed. The results are shown in Tables 1.

Example 3

Image recording was performed under the same conditions as Example 1, except that the medium position was set at the work distance of 153 mm unlike Example 1, and barcode grade valuation was performed. The results are shown in Tables 1.

Example 4

Image recording was performed under the same conditions as Example 1, except that the medium position was set at the work distance of 154 mm unlike Example 1, and barcode grade valuation was performed. The results are shown in Tables 1.

Example 5

Image recording was performed under the same conditions as Example 4 except that the distance sensor was set ON unlike Example 4, and barcode grade evaluation was performed. The results are shown in Tables 1.

Example 6

Image recording was performed under the same conditions as Example 1 except that the ambient temperature was set to 20° C. unlike Example 1, and barcode grade evaluation was performed. The results are shown in Tables 1.

Example 7

Image recording was performed under the same conditions as Example 1 except that the ambient temperature was set to 30° C. unlike Example 1, and barcode grade evaluation was performed. The results are shown in Tables 1.

Example 8

Image recording was performed under the same conditions as Example 1 except that the ambient temperature was set to 10° C. unlike Example 1, and barcode grade evaluation was performed. The results are shown in Tables 1.

Example 9

Image recording was performed under the same conditions as Example 8 except that the ambient temperature sensor was set ON unlike Example 8, and barcode grade evaluation was performed. The results are shown in Tables 1.

Example 10

Image recording was performed under the same conditions as Example 1, except that the medium position was set at the work distance of 154 mm and the ambient temperature was set to 10° C. unlike Example 1, and barcode grade valuation was performed. The results are shown in Tables 1.

Example 11

Image recording was performed under the same conditions as Example 10 except that the distance sensor and the ambient temperature sensor were set ON unlike Example 8, and barcode grade evaluation was performed. The results are shown in Tables 1.

Example 12

Image recording was performed under the same conditions as Example 1 except that inputting and setting were made from the information setting unit such that the image recording step would be started after the image erasing step was completed (with this setting, image erasing information, image recording information, and distance information would not be operated with one control file to thereby actuate the image erasing step with one control file, and after this was completed, actuate the image recording step with another control file) unlike Example 1. Barcode grade evaluation was performed in the same manner as Example 1. The results are shown in Tables 1.

In Example 12, the rewriting time from the start of the image erasing step until the end of the image recording step was 1.98 seconds.

Comparative Example 1

Image recording was performed under the same conditions as Example 1, except that the beam diameter was changed by shifting the position of the thermally reversible recording medium with a slider (81 mm during image erasing, and 150 mm during image recording) unlike Example 1. Barcode grade evaluation was performed in the same manner as Example 1. The results are shown in Tables 1.

In Comparative Example 1, the rewriting time from the start of the image recording step until the end of the image recording step was 3.54 seconds.

TABLE 1-1

| | Ambient conditions | | Apparatus setting conditions | |
|---|---|---|---|---|
| | Medium position | Ambient temp. | Distance correction sensor | Temperature correction sensor |
| Ex. 1 | 150 mm | 25° C. | OFF | OFF |
| Ex. 2 | 147 mm | 25° C. | OFF | OFF |
| Ex. 3 | 153 mm | 25° C. | OFF | OFF |
| Ex. 4 | 154 mm | 25° C. | OFF | OFF |
| Ex. 5 | 154 mm | 25° C. | ON | OFF |
| Ex. 6 | 150 mm | 20° C. | OFF | OFF |
| Ex. 7 | 150 mm | 30° C. | OFF | OFF |
| Ex. 8 | 150 mm | 10° C. | OFF | OFF |
| Ex. 9 | 150 mm | 10° C. | OFF | ON |
| Ex. 10 | 154 mm | 10° C. | OFF | OFF |
| Ex. 11 | 154 mm | 10° C. | ON | ON |
| Ex. 12 | 150 mm | 25° C. | OFF | OFF |
| Comp. Ex. 1 | 150 mm | 25° C. | OFF | OFF |

TABLE 1-2

| | Process results | | | |
|---|---|---|---|---|
| | Rewriting time | Process time | Number of targets processed | Barcode property |
| Ex. 1 | 1.75 s | 2.35 s | 1,532 targets/hr | C (2.0) |
| Ex. 2 | 1.75 s | 2.35 s | 1,532 targets/hr | C (1.9) |
| Ex. 3 | 1.75 s | 2.35 s | 1,532 targets/hr | C (1.9) |
| Ex. 4 | 1.75 s | 2.35 s | 1,532 targets/hr | D (1.2) |
| Ex. 5 | 1.75 s | 2.35 s | 1,532 targets/hr | C (2.0) |
| Ex. 6 | 1.75 s | 2.35 s | 1,532 targets/hr | C (1.9) |
| Ex. 7 | 1.75 s | 2.35 s | 1,532 targets/hr | C (1.9) |
| Ex. 8 | 1.75 s | 2.35 s | 1,532 targets/hr | D (1.3) |
| Ex. 9 | 1.75 s | 2.35 s | 1,532 targets/hr | C (2.0) |
| Ex. 10 | 1.75 s | 2.35 s | 1,532 targets/hr | D (1.0) |
| Ex. 11 | 1.75 s | 2.35 s | 1,532 targets/hr | C (2.0) |
| Ex. 12 | 1.98 s | 2.58 s | 1,395 targets/hr | C (2.0) |
| Comp. Ex. 1 | 3.54 s | 4.14 s | 870 targets/hr | C (2.0) |

* Process time means a time necessary for performing image rewriting (image erasing and then image recording) to one shipping container used on a distribution line.
* Number of targets processed means the number of shipping containers used on a distribution line to which image rewriting can be performed within 1 hour, and needs to be 1,500 targets/hour or greater.

From the results of Tables 1-1 and 1-2, when the medium position was within ±3 mm from the focal length as in Examples 2 and 3, barcode grade evaluation of C grade could be secured with the printing quality secured. However, when the medium position was ±3 mm or more from the focal length as in Example 4, the barcode grade evaluation was D grade. When the medium position was ±3 mm or more from the focal length, but distance correction was made with the distance sensor as in Example 5, the barcode grade evaluation was C grade. It would be preferable to make distance correction with the distance sensor, when fluctuation of the medium position would be large.

When adjustment was made such that optimum image quality would be obtained at an ambient temperature of 25° C., as long as the temperature was within ±5° C. from the 25° C. as in Examples 6 and 7, barcode grade evaluation of C grade could be secured with the image quality secured.

However, when the ambient temperature was greatly changed as in Example 8, the barcode grade evaluation was D grade. Even when the ambient temperature was greatly changed, but temperature correction was made with the ambient temperature sensor as in Example 9, the barcode grade evaluation was C grade. It would be preferable to make temperature correction with the ambient temperature sensor, when fluctuation of the ambient temperature would be large.

From the above results, it was revealed that in order to achieve the clients' demand for the process capacity of 1,500 shipping containers/hour or more in a rewriting system of rewriting a thermally reversible recording medium by pasting it on a shipping container used on a distribution line, the technique of Example 12 was effective but insufficient, the techniques of Examples 1 to 11 were necessary, and Comparative Example 1 greatly failed the demand.

Next, repetitive rewriting was performed with Example 1, Example 12, and Comparative Example 1. Barcode readability was confirmed in the same manner as Example 1 once in every 100 times of repetitive rewriting, to measure the number of repeating times at which the barcode grade evaluation turned to grade D. The results are shown in Table 1-3.

TABLE 1-3

| | Number of repeatable times |
|---|---|
| Ex. 1 | 3,000 times |
| Ex. 12 | 2,200 times |
| Comp. Ex. 1 | 1,800 times |

Example 13

The thermally reversible recording medium of Manufacture Example 1 was used, and as shown in FIG. 1, an optical system was formed by arranging a fiber-coupled LD light source (central wavelength: 976 nm, maximum power output: 100 W) as the laser light source 11, arranging the collimator lens 12*b* immediately after the fiber for collimating the beam to parallel light, and arranging the focal length control unit 16 and the condensing lens 18. After this, image processing was performed with a LD marker apparatus that was configured to irradiate the thermally reversible recording medium with laser light by scanning the laser light with a galvano scanner 6230H manufactured by Cambridge Inc.

<Initial Settings>

The thermally reversible recording medium was fixed with the LD marker apparatus such that the work distance from the surface of the optical head to the thermally reversible recording medium would be 150 mm, and the beam diameter was adjusted with the focal length control unit 17 such that the beam diameter would be the minimum on the thermally reversible recording medium. Here, the work distance means the distance between the laser light emitting surface of the laser light emitting unit and the thermally reversible recording medium.

In order to perform rewriting to a 20 mm×50 mm region of the thermally reversible recording medium, image information including 10 solid images each having a size of 8 mm on each side arranged on 5 columns and 2 rows, scanning velocity of 6,000 mm/s, and pitch width of 0.25 mm were input as image recording information from the information setting unit of the image setting unit. A work distance of 150 mm was input as distance information between the laser light emitting surface of the laser light emitting unit and the thermally reversible recording medium. Further, a region of 20 mm×50 mm, scanning velocity of 3,300 mm/s, and pitch width of 1.5 mm were input as image erasing information from the information setting unit. The image erasing information, the image recording information, and the distance information were input and set by means of the information setting unit, such that they would be operated with one control file.

A thermister 103ET-1 manufactured by Semitec Corporation was used as an ambient temperature sensor.

A displacement sensor HL-G112-A-C5 manufactured by Panasonic Industrial Devices SUNX Co., Ltd. was used as a distance sensor.

<Image Erasing>

The ambient temperature during image erasing was 25° C. While the ambient temperature sensor and the distance sensor were both set to OFF, erasing was performed by setting the work distance to 81 mm with the focal length control unit such that the beam diameter on the thermally reversible recording medium would be 6.0 mm.

For laser light power output control, peak power was set to 100 W, and pulse width was set to 83% (i.e., 78.8 W when converted to power output on the thermally reversible recording medium), as the irradiation power settings.

<Image Recording>

The ambient temperature during image recording was 25° C. While the ambient temperature sensor and the distance sensor were both set to OFF, recording was performed with a beam diameter on the thermally reversible recording medium of 0.48 mm. The time taken for the image recording only was 0.48 mm. For laser light power output control, peak power was set to 30 W, and pulse width was set to 78% (i.e., 23.8 W when converted to power output on the thermally reversible recording medium), as the irradiation power settings.

Repetitive rewriting of the 10 solid images of Example 13 was performed. Unerased density was measured at the repeating times of 300 times, 1,000 times, and 3,000 times, and the number of solid images that resulted in an unerased amount of 0.02 or greater was measured. The results are shown in Table 2.

Example 14

Repetitive rewriting of 10 solid images was performed in the same manner as Example 13, except that unlike Example 13, the peak power was set to 60 W and pulse width was set to 39% (i.e., 23.9 W when converted to power output on the thermally reversible recording medium) as the irradiation power settings. Unerased density was measured at the repeating times of 300 times, 1,000 times, and 3,000 times, and the number of solid images that resulted in an unerased amount of 0.02 or greater was measured The results are shown in Table 2.

Comparative Example 2

Repetitive rewriting of 10 solid images was performed in the same manner as Example 13, except that unlike Example 13, the peak power was set to 100 W and pulse width was set to 23% (i.e., 23.4 W when converted to power output on the thermally reversible recording medium) as the irradiation power settings. Unerased density was measured at the repeating times of 300 times, 1,000 times, and 3,000 times, and the number of solid images that resulted in an unerased amount of 0.02 or greater was measured The results are shown in Table 2.

TABLE 2

| | Number of repeatable times | | |
|---|---|---|---|
| | 300 times | 1,000 times | 3,000 times |
| Ex. 13 | 0 image | 0 image | 0 image |
| Ex. 14 | 0 image | 1 image | 4 images |
| Comp. Ex. 2 | 1 image | 4 images | 10 images |

<Irradiation Energy Vs. Image Density Relationship Relative to Variation of Time from End of Image Erasing Step Until Start of Image Recording Step>

An optical system was formed by arranging a fiber-coupled LD (laser diode) light source PLD 60 manufactured by IPG Photonics Corporation (central wavelength: 974 nm, maximum power output: 60 W) as the laser light source, arranging a collimator lens immediately after the fiber for collimating the beam to parallel light, and arranging a focal length control unit and a condensing lens. After this, image processing was performed with a LD marker apparatus that was configured to irradiate a thermally reversible recording medium with laser light by scanning the laser light with a galvano scanner 6230H manufactured by Cambridge Inc.

The thermally reversible recording medium was fixed with the LD marker apparatus such that the distance from the laser light emitting surface of the laser light emitting unit (optical head) to the thermally reversible recording medium would be 150 mm, and the beam diameter was adjusted with the focal length control unit such that the beam diameter would be the minimum on the thermally reversible recording medium.

In order to perform rewriting to a 50 mm×85 mm region of the thermally reversible recording medium, image information including a barcode, scanning velocity of 6,000 mm/s, and irradiation power of 42% (i.e., 23.9 W when converted to power output on the thermally reversible recording medium) were input as image recording information from the information setting unit of the image setting unit. A distance of 150 mm was input as distance information between the laser light emitting surface of the laser light emitting unit and the thermally reversible recording medium. Further, a region of 45 mm×80 mm, scanning velocity of 3,300 mm/s, pitch width of 1.0 mm, and irradiation power of 92% (i.e., 52.4 W when converted to power output on the thermally reversible recording medium) were input as image erasing information from the information setting unit. The image erasing information, the image recording information, and the distance information were input and set, such that they would be operated with one control file.

With the thermally reversible recording medium of Manufacture Example 1, a 9 mm×9 mm region thereof was erased, and after this, an 8 mm×8 mm solid image of which center would coincide with the center of the erased region was recorded, by varying the time from the end of the image erasing step until the start of the image recording step. Then, the image density was measured with a reflection densitometer (X-RITE 939 manufactured by X-Rite Inc.).

Figure 8:
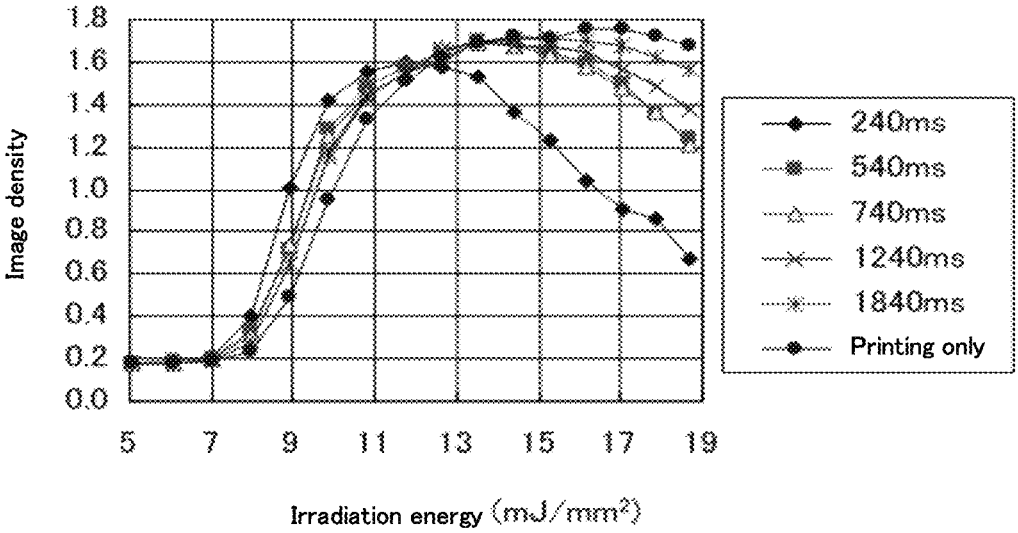
FIG. 8 is a diagram showing a relationship between developed color density and time taken from image erasing of a solid-fill image until image recording.

Image density of 8 mm×8 mm solid images that were recorded without performing image erasing was also measured with the reflection densitometer (X-RITE 939 manufactured by X-Rite Inc.). The results are shown in FIG. 8. The values in the "second" unit on the rightmost field of FIG. 8 indicate the times from the image erasing until the image recording.

From the results of FIG. 8, it was revealed that the longer the time from the end of the image erasing step until the start of the image recording step (i.e., the time from the image erasing until the image recording) (e.g., 400 ms or longer, or 600 ms or longer), the higher the saturation density would be, to thereby improve the range of irradiation energy levels at which a sufficient image density (e.g., 1.5) could be secured.

Example 15

An optical system was formed by arranging a fiber-coupled LD (laser diode) light source PLD 60 manufactured by IPG Photonics Corporation (central wavelength: 974 nm, maximum power output: 60 W) as the laser light source, arranging a collimator lens immediately after the fiber for collimating the beam to parallel light, and arranging a focal length control unit and a condensing lens. After this, image processing was performed with a LD marker apparatus that was configured to irradiate a thermally reversible recording medium with laser light by scanning the laser light with a galvano scanner 6230H manufactured by Cambridge Inc.

The thermally reversible recording medium was fixed with the LD marker apparatus such that the distance from the laser light emitting surface of the laser light emitting unit (optical head) to the thermally reversible recording medium would be 150 mm, and the beam diameter was adjusted with the focal length control unit such that the beam diameter would be the minimum on the thermally reversible recording medium.

In order to perform rewriting to a 50 mm×85 mm region of the thermally reversible recording medium, image information including a barcode, scanning velocity of 6,000 mm/s, and irradiation power of 42% (i.e., 23.9 W when converted to power output on the thermally reversible recording medium) were input as image recording information from the information setting unit of the image setting unit. A distance of 150 mm was input as distance information between the laser light emitting surface of the laser light emitting unit and the thermally reversible recording medium. Further, a region of 45 mm×80 mm, scanning velocity of 3,300 mm/s, pitch width of 1.0 mm, and irradiation power of 92% (i.e., 52.4 W when converted to power output on the thermally reversible recording medium) were input as image erasing information from the information setting unit. The image erasing information, the image recording information, and the distance information were input and set, such that they would be operated with one control file.

Next, regarding the image pattern shown in FIG. 9A, image erasing was performed in the image erasing order shown in FIG. 9D by taking a time of 1,100 ms, and 100 ms after this, image recording was performed in the recording order [(1) to (11)] shown in FIG. 9G by taking 600 ms. At this time, the throughput of the rewriting system of rewriting a thermally reversible recording medium by pasting it on a shipping container used on a distribution line was 1,500 shipping containers/hour (i.e., rewriting completed in 2.4 seconds per shipping container). In FIG. 9D to FIG. 9N, enclosure with a circle represents image recording, and enclosure with a frame together with arrows represent image erasing.

Next, the image density and the repetition durability of the image obtained in Example 15 were evaluated in the manner described below. The results are shown in Table 3.

<Image Density>

The recorded image density was measured with a reflection densitometer (X-RITE 939 manufactured by X-Rite Inc.). The image density of every solid-fill image on the thermally reversible recording medium was measured, and the worst value was employed as the measured value and evaluated based on the following criteria.

[Evaluation Criteria]

A: good (image density of 1.5 or greater)

B: bad (image density of less than 1.5)

<Repetition Durability>

Unerased density (density after erasing—background density) when the set of image recording and image erasing had been repeated 1,000 times was measured with a reflection densitometer (X-RITE 939 manufactured by X-Rite Inc.). Every erased solid-fill image portion on the thermally reversible recording medium was measured, and the worst value was employed as the measured value and evaluated based on the following criteria. "Background density" means the initial image density.

[Evaluation Criteria]

A: good (unerased density (density after erasing—background density) of less than 0.02

B: bad (unerased density (density after erasing—background density) of 0.02 or greater Example 16

Image density and repetition durability were evaluated under the same conditions as Example 15, except that the time from the image erasing until the image recording was set to 500 ms unlike Example 15. The results are shown in Table 3.

Comparative Example 3

Figure 9H:
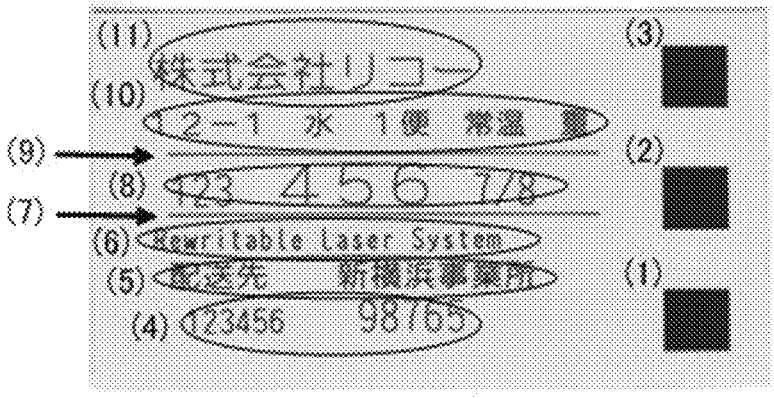
FIG. 9H is a schematic diagram showing an example recording order in Examples and Comparative Examples.

Image density and repetition durability were evaluated under the same conditions as Example 15, except that the recording order was changed from FIG. 9G [(1) to (11)] to FIG. 9H [(1) to (11)] unlike Example 15. The results are shown in Table 3.

Example 17

Figure 9I:
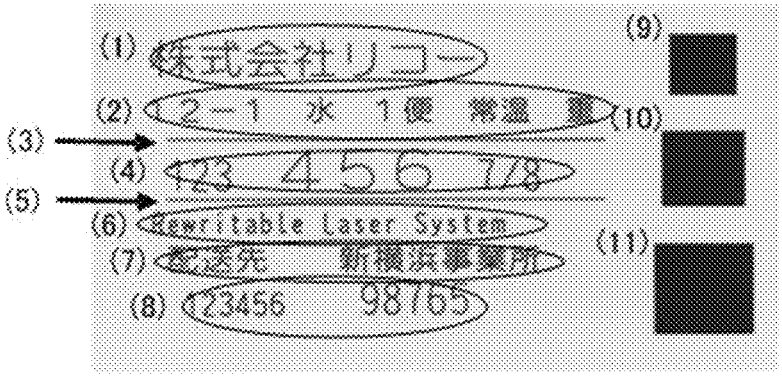
FIG. 9I is a schematic diagram showing an example recording order in Examples and Comparative Examples.

Image density and repetition durability were evaluated under the same conditions as Example 15, except that the image pattern of FIG. 9B was used and the recording order was changed from FIG. 9G [(1) to (11)] of to FIG. 9I [(1) to (11)] unlike Example 15. The results are shown in Table 3.

Comparative Example 4

Figure 9J:
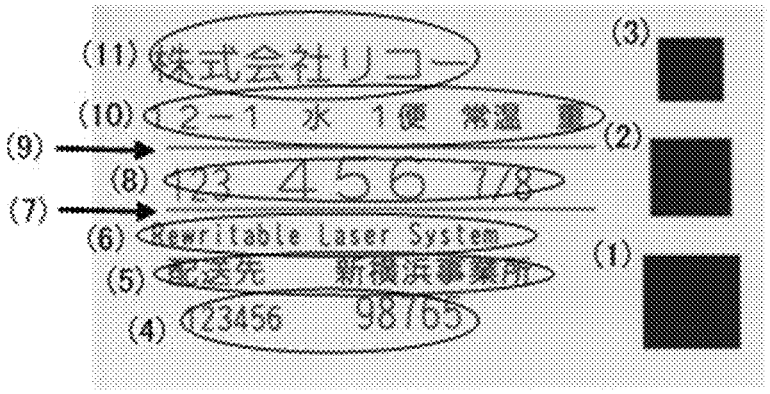
FIG. 9J is a schematic diagram showing an example recording order in Examples and Comparative Examples.

Image density and repetition durability were evaluated under the same conditions as Example 15, except that the image pattern of FIG. 9B was used and the recording order was changed from FIG. 9G [(1) to (11)] of to FIG. 9J [(1) to (11)] unlike Example 15. The results are shown in Table 3.

Example 18

Figure 9K:
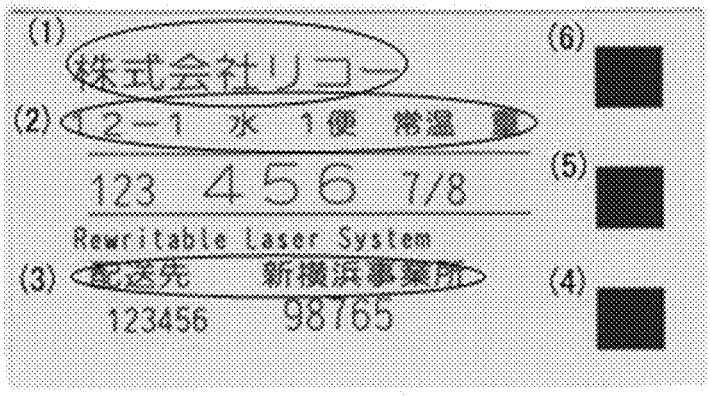
FIG. 9K is a schematic diagram showing an example recording order in Examples and Comparative Examples.

Image density and repetition durability were evaluated under the same conditions as Example 15, except that for the image pattern shown in FIG. 9A, the erasing order was that shown in FIG. 9E [(1) to (6)] and the recording order was that shown in FIG. 9K [(1) to (6)] unlike Example 15. The results are shown in Table 3.

Example 19

Figure 9L:
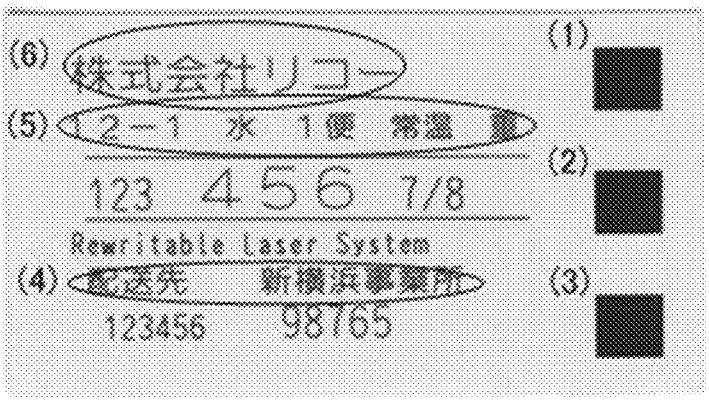
FIG. 9L is a schematic diagram showing an example recording order in Examples and Comparative Examples.

Image density and repetition durability were evaluated under the same conditions as Example 15, except that for the image pattern shown in FIG. 9A, the erasing order was that shown in FIG. 9E [(1) to (6)] and the recording order was that shown in FIG. 9L [(1) to (6)] unlike Example 15. The results are shown in Table 3.

Example 20

Image density and repetition durability were evaluated under the same conditions as Example 15, except that for the image pattern shown in FIG. 9A, the erasing order was that shown in FIG. 9F [(1) to (6)] and the recording order was that shown in FIG. 9K [(1) to (6)] unlike Example 15. The results are shown in Table 3.

Comparative Example 5

Image density and repetition durability were evaluated under the same conditions as Example 15, except that for the image pattern shown in FIG. 9A, the erasing order was that shown in FIG. 9F [(1) to (6)] and the recording order was that shown in FIG. 9L [(1) to (6)] unlike Example 15. The results are shown in Table 3.

Example 21

Figure 9M:
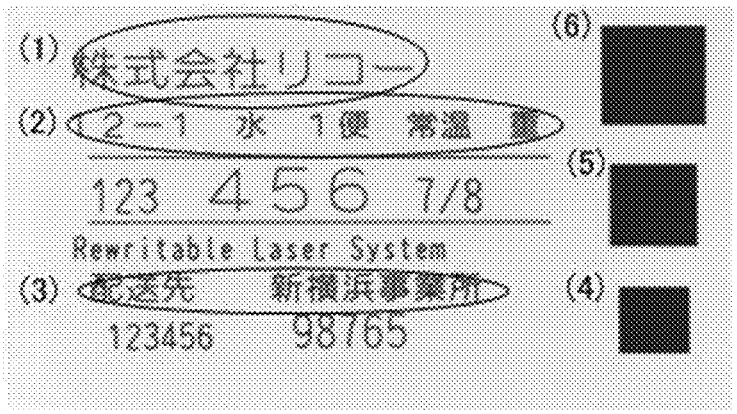
FIG. 9M is a schematic diagram showing an example recording order in Examples and Comparative Examples.

Image density and repetition durability were evaluated under the same conditions as Example 15, except that the image pattern shown in FIG. 9C was used, and the erasing order was that shown in FIG. 9F [(1) to (6)] and the recording order was that shown in FIG. 9M [(1) to (6)] unlike Example 15. The results are shown in Table 3.

Comparative Example 6

Figure 9N:
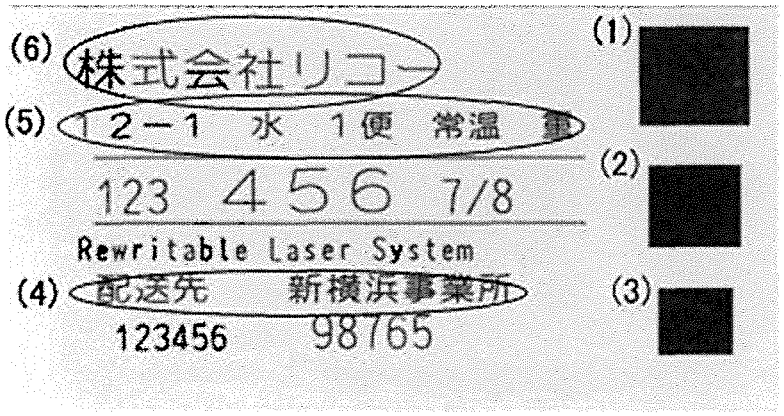
FIG. 9N is a schematic diagram showing an example recording order in Examples and Comparative Examples.

Image density and repetition durability were evaluated under the same conditions as Example 15, except that the image pattern shown in FIG. 9C was used, and the erasing order was that shown in FIG. 9F [(1) to (6)] and the recording order was that shown in FIG. 9N [(1) to (6)] unlike Example 15. The results are shown in Table 3.

TABLE 3

| | Image pattern | Image erasing order | Image recording order | Time from image erasing until image recording | Image density | Repetition durability |
|---|---|---|---|---|---|---|
| Ex. 15 | FIG. 9A | FIG. 9D | FIG. 9G | 100 ms | A | A |
| Ex. 16 | FIG. 9A | FIG. 9D | FIG. 9G | 500 ms | A | A |
| Comp. Ex. 3 | FIG. 9A | FIG. 9D | FIG. 9H | 100 ms | B | B |
| Ex. 17 | FIG. 9B | FIG. 9D | FIG. 9I | 100 ms | A | A |
| Comp. Ex. 4 | FIG. 9B | FIG. 9D | FIG. 9J | 100 ms | B | B |
| Ex. 18 | FIG. 9A | FIG. 9E | FIG. 9K | 100 ms | A | A |
| Ex. 19 | FIG. 9A | FIG. 9E | FIG. 9L | 100 ms | A | A |
| Ex. 20 | FIG. 9A | FIG. 9F | FIG. 9K | 100 ms | A | A |
| Comp. Ex. 5 | FIG. 9A | FIG. 9F | FIG. 9L | 100 ms | B | B |
| Ex. 21 | FIG. 9C | FIG. 9F | FIG. 9M | 100 ms | A | A |

TABLE 3-continued

| | Image pattern | Image erasing order | Image recording order | Time from image erasing until image recording | Image density | Repetition durability |
|---|---|---|---|---|---|---|
| Comp. Ex. 6 | FIG. 9C | FIG. 9F | FIG. 9N | 100 ms | B | B |

From the results of Table 3, it was revealed that Examples 15 to 21 were better than Comparative Examples 3 to 6 in the image density and the repetition durability.

INDUSTRIAL APPLICABILITY

The image processing apparatus of the present invention enables image rewriting (image erasing and then image recording) to a thermally reversible recording medium to be performed with one apparatus, and enables image rewriting at high speed. By constituting a system that can realize image rewriting with one image processing apparatus to thereby reduce 2 apparatuses, namely an image erasing apparatus and an image recording apparatus to one apparatus, it is possible to save the costs and space of the apparatus itself, and by simplifying the system configured to control the image processing apparatus (conveyor, etc.), it is also possible to save costs, and to eliminate the time taken to move from the image erasing apparatus to the image recording apparatus and the stopping time at the image recording apparatus position and to thereby realize image rewriting at high speed.

By performing image recording in a heat accumulated state immediately after image erasing that is due to high speed switching from the image recording step to the image erasing step, it is possible to develop color even when the irradiation power setting is low during the image recording, and to reduce damages to the thermally reversible recording medium and improve the repetition durability, while by suppressing the irradiation power to low level, it is possible to reduce the load on the laser light source, which improves the life of the apparatus.

By using image erasing information, image recording information, and distance information set by means of the information setting unit as one control file, it is possible to reduce the time taken to transfer a condition setting file to the image processing apparatus, to further reduce the process time taken for the image rewriting, and to realize image rewriting at high speed that can satisfy the demand of the clients'.

Hence, the image processing apparatus of the present invention can be widely used for admission tickets, stickers for frozen food containers, industrial products, and various chemical containers, wide screens for distribution management, production line management, etc., and various displays, and is particularly suitable for use in a distribution system, a delivery system, a line management system in a factory, etc.

Aspects of the present invention are as follows, for example.

<1> An image processing apparatus configured to perform by itself image erasing and image recording to a thermally reversible recording medium by irradiating the thermally reversible recording medium with laser light and heating it, including:

a laser light emitting unit configured to emit the laser light;

a laser light scanning unit configured to scan the laser light over a laser light irradiation surface of the thermally reversible recording medium;

a focal length control unit including a position-shiftable lens system between the laser light emitting unit and the laser light scanning unit and configured to control focal length of the laser light by adjusting a position of the lens system; and an information setting unit configured to receive and set image erasing information, image recording information, and distance information representing a distance between the thermally reversible recording medium and a laser light emitting surface of the laser light emitting unit, which are input thereto, wherein during image erasing, the focal length control unit performs control to defocus at the position of the thermally reversible recording medium, wherein during image recording, the focal length control unit controls the position of the thermally reversible recording medium to be at a focal length, and wherein immediately after image erasing based on the image erasing information set by the information setting unit is completed, image recording is performed based on the image recording information.

<2> The image processing apparatus according to <1>, wherein the image erasing information, the image recording information, and the distance information set by the information setting unit are used as one control file.

<3> The image processing apparatus according to <1> or <2>, wherein the focal length control unit defocuses at the position of the thermally reversible recording medium during image erasing to control a position in front of the position of the thermally reversible recording medium to be at a focal length.

<4> The image processing apparatus according to any one of <1> to <3>, further including:

a distance measuring unit configured to measure the distance between the thermally reversible recording medium and the laser light emitting surface of the laser light emitting unit, wherein the distance information set by the information setting unit is corrected based on a result of measurement by the distance measuring unit.

<5> The image processing apparatus according to any one of <1> to <4>, further including:

a temperature measuring unit configured to measure at least a temperature selected from the group consisting of a temperature of the thermally reversible recording medium and an ambient temperature around the thermally reversible recording medium, wherein irradiation energy is controlled based on a result of measurement by the temperature measuring unit.

<6> The image processing apparatus according to any one of <1> to <5>, wherein the laser light emitting unit controls power output of the laser light based on pulse length and peak power, and varies peak power during image erasing from peak power during image recording.

<7> The image processing apparatus according to <6>, wherein the peak power during image erasing is higher than the peak power during image recording.

<8> The image processing apparatus according to any one of <1> to <7>, wherein a laser light source of the laser light emitting unit is a fiber-coupled laser.

<9> The image processing apparatus according to any one of <1> to <8>, wherein the laser light to be emitted has a wavelength of from 700 nm to 1,600 nm.

<10> An image processing method using the image processing apparatus according to any one of <1> to <5>, including:

an image recording step of at least any of irradiating the thermally reversible recording medium with laser light and heating the thermally reversible recording medium to thereby record thereon, a single-line drawn image to be formed by a single laser light drawn line, and irradiating the thermally reversible recording medium with laser light beams having certain intervals therebetween in parallel and heating the thermally reversible recording medium to thereby record thereon, a plural-line drawn image to be formed by a plurality of laser light drawn lines; and an image erasing step of irradiating the thermally reversible recording medium with laser light and heating the thermally reversible recording medium to thereby erase at least any of the single-line drawn image and the plural-line drawn image, wherein in the image recording step after the image erasing step is performed, the single-line drawn image is at least partially recorded before the plural-line drawn image is recorded.

<11> The image processing method according to <10>, wherein in the image recording step, the single-line drawn image is completely recorded before the plural-line drawn image is recorded.

<12> The image processing method according to <10> or <11>, wherein of the plural-line drawn images, drawn images with smaller numbers of drawn lines are recorded earlier in the image recording step.

<13> The image processing method according to any one of <10> to <12>, wherein of the plural-line drawn images, drawn images with smaller areas are recorded earlier in the image recording step.

<14> An image processing method using the image processing apparatus according to any one of <1> to <5>, including:

an image recording step of at least any of irradiating a thermally reversible recording medium with laser light and heating the thermally reversible recording medium to thereby record thereon, a single-line drawn image to be formed by a single laser light drawn line, and irradiating the thermally reversible recording medium with laser light beams having certain intervals therebetween in parallel and heating the thermally reversible recording medium to thereby record thereon, a plural-line drawn image to be formed by a plurality of laser light drawn lines; and an image erasing step of irradiating the thermally reversible recording medium with laser light and heating the thermally reversible recording medium to thereby erase at least any of the single-line drawn image and the plural-line drawn image, wherein in the image erasing step before the image recording step is performed, a region to which a plural-line drawn image is to be recorded in the image recording step is completely erased, and after this, a region to which a single-line drawn image is to be recorded in the image recording step is at least partially erased.

<15> The image processing method according to <14>, wherein in the image erasing step before the image recording step is performed, a region to which a plural-line drawn image is to be recorded in the image recording step is completely erased, and after this, a region to which a single-line drawn image is to be recorded in the image recording step is completely erased.

<16> The image processing method according to <14> or <15>, wherein in the image erasing step, of regions to which plural-line drawn images are to be recorded in the image recording step, regions to which plural-line drawn images with larger numbers of drawn lines are to be recorded are erased earlier.

<17> The image processing method according to any one of <14> to <16>, wherein in the image erasing step, of regions to which plural-line drawn images are to be recorded in the image recording step, regions to which plural-line drawn images with larger areas are to be recorded are erased earlier.

<18> The image processing method according to any one of <10> to <17>, wherein a time from when the image erasing step is completed until when the image recording step is started is 400 ms or longer.

<19> A conveyor system, including at least any of:

the image processing apparatus according to any one of <1> to <9>; and the image processing method according to any one of <10> to <18>, wherein image processing is performed based on information from the conveyor system.

<20> The conveyor system according to <19>, wherein image information to be rewritten in the conveyor system includes at least barcode information, and wherein immediately after rewriting, barcode reading is performed.

REFERENCE SIGNS LIST

1 laser oscillator
2 collimator lens
3 focal length control mechanism
4 galvano meter
4A galvano mirror
5 scanning unit
6 protection glass
10 laser light
11 laser light source
12*b* collimator lens
13 galvano mirror
15 thermally reversible recording medium
16 diffusing lens (focal length control unit)
17 lens position control mechanism
18 condensing lens system
19 optical head
100 thermally reversible recording medium,
101 support member+first oxygen barrier layer
102 thermally reversible recording layer
103 intermediate layer
104 second oxygen barrier layer
105 hollow layer
106 ultraviolet absorbing layer
201 laser light drawn image
202 laser light drawn image
211 laser light drawn image
212 laser light drawn image
221 laser light drawn image
222 laser light drawn image

The invention claimed is:

1. An image processing apparatus configured to perform by itself image erasing and image recording to a thermally reversible recording medium by irradiating the thermally reversible recording medium with laser light and heating it, comprising:

a laser light emitting unit configured to emit the laser light;

a laser light scanning unit configured to scan the laser light over a laser light irradiation surface of the thermally reversible recording medium;

a focal length control unit that comprises a position-shiftable lens system between the laser light emitting unit and the laser light scanning unit and is configured to control focal length of the laser light by adjusting a position of the lens system; and an information setting unit configured to receive and set image erasing information, image recording information, and distance information representing a distance between the thermally reversible recording medium and a laser light emitting surface of the laser light emitting unit, which are input thereto, wherein during image erasing, the focal length control unit performs control to defocus at a position of the thermally reversible recording medium, wherein during image recording, the focal length control unit controls the position of the thermally reversible recording medium to be at a focal length, wherein immediately after image erasing based on the image erasing information set by the information setting unit is completed, image recording is performed based on the image recording information, and wherein the laser light emitting unit controls power output of the laser light by both of (i) a pulse control method of controlling the power output of the laser light based on pulse length and (ii) a peak power control method of controlling the power output of the laser light based on peak power, and varies peak power during image erasing from peak power during image recording.

2. The image processing apparatus according to claim 1, wherein the image erasing information, the image recording information, and the distance information set by the information setting unit are used as one control file.

3. The image processing apparatus according to claim 1, wherein the focal length control unit defocuses at the position of the thermally reversible recording medium during image erasing to control a position in front of the position of the thermally reversible recording medium to be at a focal length.

4. The image processing apparatus according to claim 1, further comprising:

a distance measuring unit configured to measure the distance between the thermally reversible recording medium and the laser light emitting surface of the laser light emitting unit, wherein the distance information set by the information setting unit is corrected based on a result of measurement by the distance measuring unit.

5. The image processing apparatus according to claim 1, further comprising:

a temperature measuring unit configured to measure at least a temperature selected from the group consisting of a temperature of the thermally reversible recording medium and an ambient temperature around the thermally reversible recording medium, wherein irradiation energy is controlled based on a result of measurement by the temperature measuring unit.

6. The image processing apparatus according to claim 1, wherein the peak power during image erasing is higher than the peak power during image recording.

7. The image processing apparatus according to claim 1, wherein a laser light source of the laser light emitting unit is a fiber-coupled laser.

8. The image processing apparatus according to claim 1, wherein the laser light to be emitted has a wavelength of from 700 nm to 1,600 nm.

9. The image processing apparatus according to claim 1, wherein the laser light emitting unit employs the peak power control method to control power output of the laser light for peak power change upon switching between image erasing and image recording, and wherein the laser light emitting unit employs the pulse control method to control power output of the laser light for power control within image recording and image erasing.

10. An image processing method using an image processing apparatus configured to perform by itself image erasing and image recording to a thermally reversible recording medium by irradiating the thermally reversible recording medium with laser light and heating it, the image processing apparatus comprising:

a laser light emitting unit configured to emit the laser light;

a laser light scanning unit configured to scan the laser light over a laser light irradiation surface of the thermally reversible recording medium;

a focal length control unit that comprises a position-shiftable lens system between the laser light emitting unit and the laser light scanning unit and is configured to control focal length of the laser light by adjusting a position of the lens system; and an information setting unit configured to receive and set image erasing information, image recording information, and distance information representing a distance between the thermally reversible recording medium and a laser light emitting surface of the laser light emitting unit, which are input thereto, wherein during image erasing, the focal length control unit performs control to defocus at a position of the thermally reversible recording medium, wherein during image recording, the focal length control unit controls the position of the thermally reversible recording medium to be at a focal length, wherein immediately after image erasing based on the image erasing information set by the information setting unit is completed, image recording is performed based on the image recording information, and wherein the image processing method performed by the image processing apparatus comprises:

performing image recording by at least any of irradiating the thermally reversible recording medium with laser light and heating the thermally reversible recording medium to thereby record thereon, a single-line drawn image to be formed by a single laser light drawn line, and irradiating the thermally reversible recording medium with laser light beams having certain intervals therebetween in parallel and heating the thermally reversible recording medium to thereby record thereon, a plural-line drawn image to be formed by a plurality of laser light drawn lines; and performing image erasing by irradiating the thermally reversible recording medium with laser light and heating the thermally reversible recording medium to thereby erase at least any of the single-line drawn image and the plural-line drawn image, wherein in the image recording after the image erasing is performed, the single-line drawn image is at least partially recorded before the plural-line drawn image is recorded.

11. The image processing method according to claim 10, wherein in the image recording, the single-line drawn image is completely recorded before the plural-line drawn image is recorded.

12. The image processing method according to claim 10, wherein of the plural-line drawn images, drawn images with smaller numbers of drawn lines are recorded earlier in the image recording.

13. The image processing method according to claim 10, wherein of the plural-line drawn images, drawn images with smaller areas are recorded earlier in the image recording.

14. The image processing method according to claim 10, wherein a time from when the image erasing is completed until when the image recording is started is 400 ms or longer.

15. A conveyor system, comprising any of:

the image processing apparatus according to claim 1; and the image processing method according to claim 10, wherein image processing is performed based on information from the conveyor system.

16. The conveyor system according to claim 15, wherein image information to be rewritten in the conveyor system comprises at least barcode information, and wherein immediately after rewriting, barcode reading is performed.

17. An image processing method using an image processing apparatus configured to perform by itself image erasing and image recording to a thermally reversible recording medium by irradiating the thermally reversible recording medium with laser light and heating it, the image processing apparatus comprising:

a laser light emitting unit configured to emit the laser light;

a laser light scanning unit configured to scan the laser light over a laser light irradiation surface of the thermally reversible recording medium;

a focal length control unit that comprises a position-shiftable lens system between the laser light emitting unit and the laser light scanning unit and is configured to control focal length of the laser light by adjusting a position of the lens system; and an information setting unit configured to receive and set image erasing information, image recording information, and distance information representing a distance between the thermally reversible recording medium and a laser light emitting surface of the laser light emitting unit, which are input thereto, wherein during image erasing, the focal length control unit performs control to defocus at a position of the thermally reversible recording medium, wherein during image recording, the focal length control unit controls the position of the thermally reversible recording medium to be at a focal length, wherein immediately after image erasing based on the image erasing information set by the information setting unit is completed, image recording is performed based on the image recording information, and wherein the image processing method performed by the image processing apparatus comprises:

performing image recording by at least any of irradiating a thermally reversible recording medium with laser light and heating the thermally, reversible recording medium to thereby record thereon, a single-line drawn image to be formed by a single laser light drawn line, and irradiating the thermally reversible recording medium with laser light beams having certain intervals therebetween in parallel and heating the thermally reversible recording medium to thereby record thereon, a plural-line drawn image to be formed by a plurality of laser light drawn lines; and performing image erasing by irradiating the thermally reversible recording medium with laser light and heating the thermally reversible recording medium to thereby erase at least any of the single-line drawn image and the plural-line drawn image, wherein in the image erasing before the image recording is performed, a region to which a plural-line drawn image is to be recorded in the image recording is completely erased, and after this, a region to which a single-line drawn image is to be recorded in the image recording is at least partially erased.

18. The image processing method according to claim 17, wherein in the image erasing before the image recording is performed, a region to which a plural-line drawn image is to be recorded in the image recording is completely erased, and after this, a region to which a single-line drawn image is to be recorded in the image recording is completely erased.

19. The image processing method according to claim 17, wherein in the image erasing, of regions to which plural-line drawn images are to be recorded in the image recording, regions to which plural-line drawn images with larger numbers of drawn lines are to be recorded are erased earlier.

20. The image processing method according claim 17, wherein in the image erasing, of regions to which plural-line drawn images are to be recorded in the image recording, regions to which plural-line drawn images with larger areas are to be recorded are erased earlier.

* * * * *